US012532956B2

(12) United States Patent
Waters

(10) Patent No.: US 12,532,956 B2
(45) Date of Patent: Jan. 27, 2026

(54) ACCESSORY POCKET SYSTEM AND APPARATUS

(71) Applicant: Anthony Waters, Miami, FL (US)

(72) Inventor: Anthony Waters, Miami, FL (US)

( * ) Notice: Subject to any disclaimer, the term of this patent is extended or adjusted under 35 U.S.C. 154(b) by 106 days.

(21) Appl. No.: 18/125,837

(22) Filed: Mar. 24, 2023

(65) Prior Publication Data

US 2023/0301421 A1 Sep. 28, 2023

Related U.S. Application Data

(60) Provisional application No. 63/323,801, filed on Mar. 25, 2022.

(51) Int. Cl.
*A45F 5/02* (2006.01)
*A45F 5/00* (2006.01)

(52) U.S. Cl.
CPC ..... *A45F 5/021* (2013.01); *A45F 2005/006* (2013.01); *A45F 5/1516* (2025.01); *A45F 5/155* (2025.01)

(58) Field of Classification Search
CPC ..... A45F 5/1516; A45F 5/155; A45F 5/021; A45F 2005/006; A45F 2004/023; A45F 4/02
USPC ..... 224/578
See application file for complete search history.

(56) References Cited

U.S. PATENT DOCUMENTS

| | | | | |
|---|---|---|---|---|
| 7,160,028 | B1 * | 1/2007 | Linday | A45C 9/00 150/108 |
| 9,155,378 | B2 | 10/2015 | Waters | |
| 9,923,590 | B1 * | 3/2018 | Picking | H04B 1/385 |
| 11,304,500 | B2 * | 4/2022 | Thiel | H02J 7/0047 |
| 2007/0228099 | A1 * | 10/2007 | Beda | A45C 11/00 224/666 |
| 2012/0160858 | A1 * | 6/2012 | Vossman | A45C 11/22 220/694 |
| 2012/0248160 | A1 * | 10/2012 | Seimetz | A45F 5/00 224/183 |

FOREIGN PATENT DOCUMENTS

| | | | | |
|---|---|---|---|---|
| WO | WO-2006089078 | A2 * | 8/2006 | A45C 11/04 |

* cited by examiner

*Primary Examiner* — Scott T Mcnurlen
(74) *Attorney, Agent, or Firm* — Duane Morris LLP

(57) ABSTRACT

An accessory pocket apparatus and system are disclosed. In one example, an apparatus includes a first pocket layer coupled to a second pocket layer. The first pocket layer and the second pocket layer define a pocket with a first opening and a second opening opposite the first opening. The apparatus also includes a first tab coupled to the second pocket layer. The first tab is configured to fold into the first opening of the pocket. Further, the apparatus includes a second tab coupled to the second pocket layer. The second tab is configured to fold into a third opening of the pocket. The apparatus also includes a transparent cover coupled to the first pocket layer, and a mesh backing coupled to the second pocket layer.

13 Claims, 28 Drawing Sheets

ACCESSORY POCKET SYSTEM AND APPARATUS

CROSS-REFERENCE TO RELATED APPLICATIONS

This application claims priority to U.S. Provisional Application No. 63,323,801, filed on Mar. 25, 2022 and entitled "The Interchangeable Pocket Accessory System aka 'PHONE CARD KITS'," which is hereby incorporated by reference in its entirety.

FIELD OF THE INVENTION

The disclosure relates generally to accessory devices for holding items.

BACKGROUND

People often carry documents, such as identification documents (e.g., driver licenses, passports, etc.) and other important identifying papers, such as while traveling. For example, travelers may maintain with them one or more identification documents while traveling outside their native country, drivers may carry forms of identification when driving a vehicle, and patrons may carry forms of identification when visiting restaurants or other places of entertainment. Often times, a person may misplace or lose an identification document. In some instances, such as when travelling, an identification document may be stolen from a person. While some persons may maintain such documents in, for example, a pants pocket or a purse, such forms of storage are susceptible to pickpocketing. In addition, in the example of the purse, the entire purse may be stolen, thereby losing the identification document along with the purse.

Additionally, portable devices such as cellphones (e.g., smartphones) are vastly used in today's society. Often times people carry these portable devices with them as they go about their day. Existing methods of storing these portable devices, however, are susceptible to misplacement and/or stealing. In addition, often times, when stored, a storage container does not allow a person to operate the device (e.g., such as when stored in a purse, or stored in a container that prevents access to a touchscreen). As such, there are opportunities to address these and other issues with transporting documents and portable devices.

SUMMARY

In some examples, an apparatus comprises a first pocket layer coupled to a second pocket layer, the first pocket layer and the second pocket layer defining a pocket with a first opening and a second opening opposite the first opening. The apparatus also comprises a first tab coupled to the second pocket layer, the first tab configured to fold into the first opening of the pocket. Further, the apparatus comprises a second tab coupled to the second pocket layer, the second tab configured to fold into a third opening of the pocket. The apparatus also comprises a transparent cover coupled to the first pocket layer, and a mesh backing coupled to the second pocket layer.

In some examples, an apparatus comprises a first pocket layer coupled to a second pocket layer, the first pocket layer and the second pocket layer defining a first pocket with a first opening and a second opening opposite the first opening. The apparatus also comprises a third pocket layer coupled to the second pocket layer, the second pocket layer and the third pocket layer defining a second pocket with a first opening. The apparatus further comprises a first tab coupled to the third pocket layer, the first tab configured to fold into the first opening of the second pocket. The apparatus also comprises a second tab coupled to the third pocket layer, the second tab configured to fold into a second opening of the second pocket. The apparatus further comprises a transparent cover coupled to the first pocket layer.

In some examples, an apparatus comprises a first rigid surface opposite a second rigid surface, the first rigid surface and the second rigid surface defining a rigid layer. The apparatus also comprises a first tab coupled to a first side of the rigid layer, and a second tab coupled to a second side of the rigid layer, each of the first tab and the second tab comprising an opening there through. In some examples, the first side is adjacent the second side. In some examples, the first side is opposite the second side.

BRIEF DESCRIPTION OF THE DRAWINGS

The features and advantages of the present disclosures will be more fully disclosed in, or rendered obvious by the following detailed descriptions of example embodiments. The detailed descriptions of the example embodiments are to be considered together with the accompanying drawings wherein like numbers refer to like parts and further wherein.

DETAILED DESCRIPTION

Figure 1A:
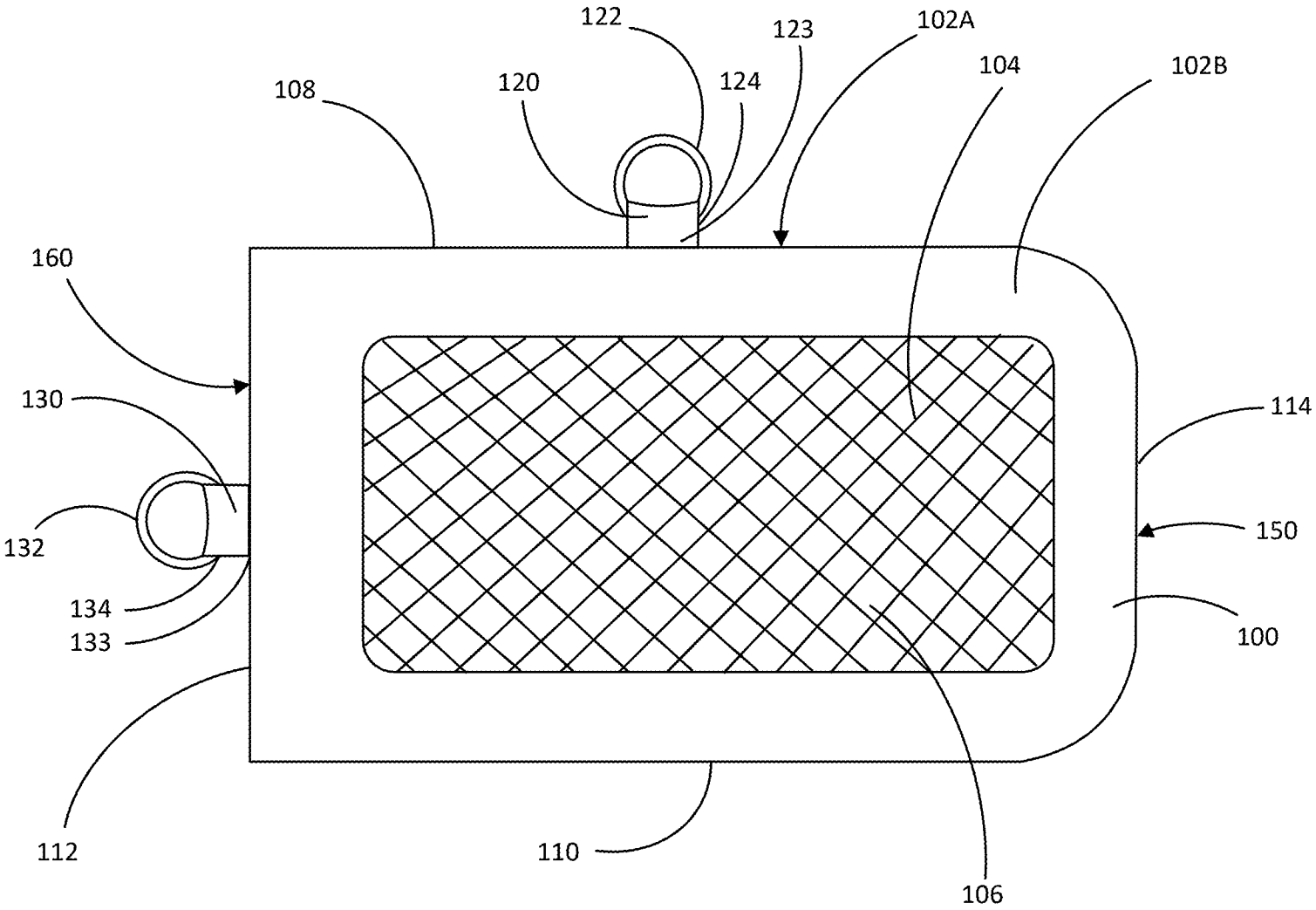
FIGS. 1A, 1B, 1C, 1D, 1E, 1F, 1G, 1H, 1I, 1J, 1K, and 1L illustrate a storage apparatus with a pocket and multiple tabs, in accordance with some embodiments.
Figure 1B:
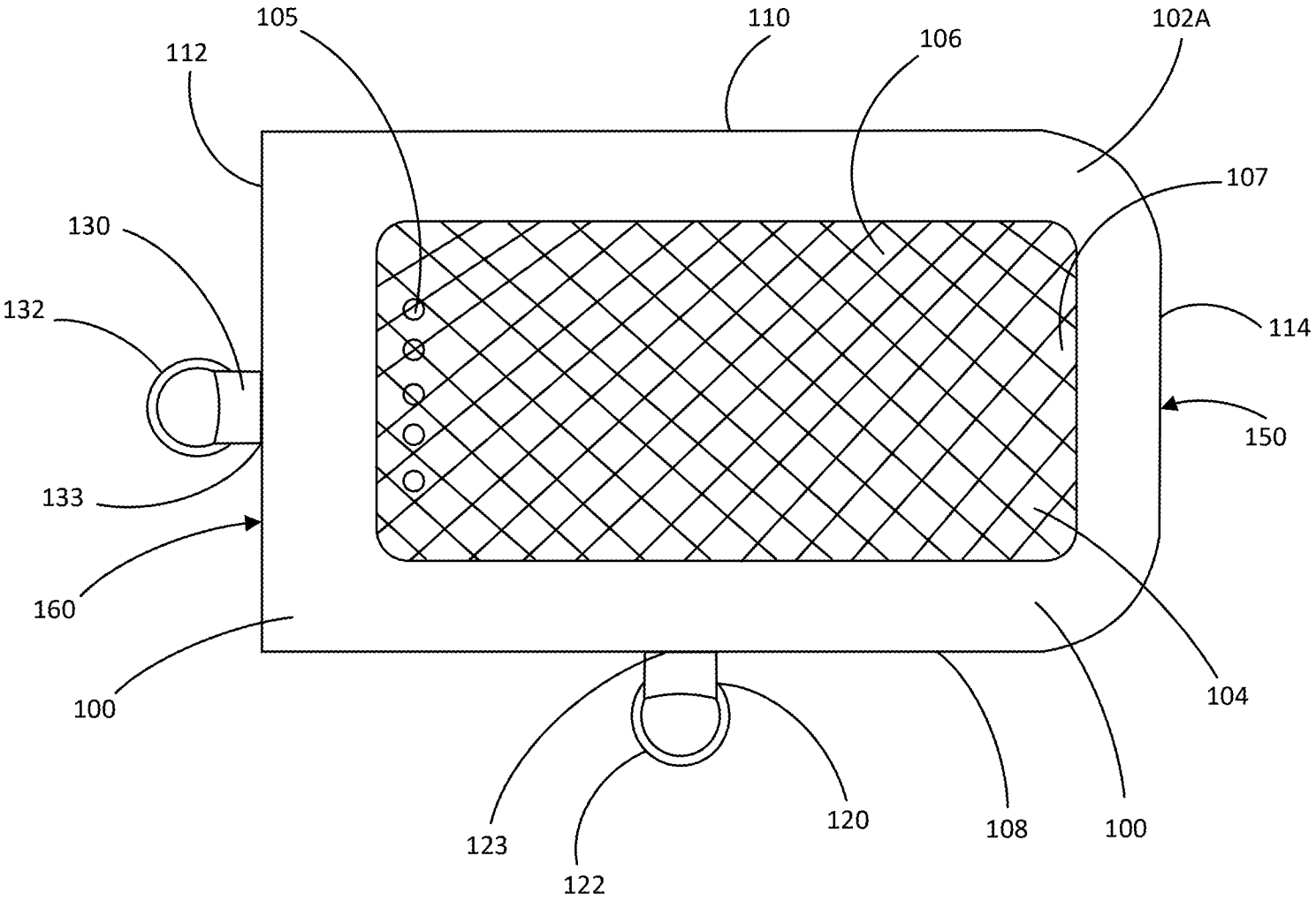

The description of the preferred embodiments is intended to be read in connection with the accompanying drawings, which are to be considered part of the entire written description of these disclosures. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling, and the like, such as "connected," "coupled," and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

Turning to the drawings, FIGS. 1A, 1B, 1C, 1D, 1E, 1F, 1G, 1H, 1I, 1J, 1K, and 1L illustrate a storage apparatus 100 that includes a first pocket layer 102A and a second pocket layer 102B that define a pocket with a first opening 160 and, in some examples, a second opening 150. The first pocket layer 102A is sown (e.g., stitched) to the second pocket layer 102B along a first side 108 as well as along a second side 110 opposite the first side 108. The first pocket layer 102A may also be sown to the second pocket layer 102B along a bottom side 114. The first opening 160 may extend along a top side 112 of the storage apparatus 100. In some examples, a width of the first opening 160 is between 75% and 95% of the width of the top side 112. The second opening 150 may extend along a bottom side 114 of the storage apparatus 100. In some examples, a width of the second opening 150 is between 15% and 35% of the width of the bottom side 114.

Further, the first pocket layer 102A may be sown to a transparent cover 106. The transparent cover 106 allows for the viewing of an item, such as a document or smartphone, that is secured within the storage apparatus 100. For example, a user may provide input to a smartphone secured within the storage apparatus 100 through the transparent cover 106. The transparent cover 106 may include one or more apertures 105, 107. In addition, the second pocket layer 102B may be sown to a mesh backing 104. The mesh backing 104 may allow, for instance, for the clear transmission of audio that may be emitted from a smartphone secured within the storage apparatus 100.

The storage apparatus 100 may further include a top tab 130 that is sown to an inside surface 133 of the second pocket layer 102B (i.e., the side of the second pocket layer 102B facing the formed pocket) along the top side 112. The top tab 130 may include an opening 134 whereby a holding device, such as key ring 132, may be placed through the opening 134. The top tab 130, while semi-rigid, is flexible and can fold into the first opening 160.

Figure 1C:
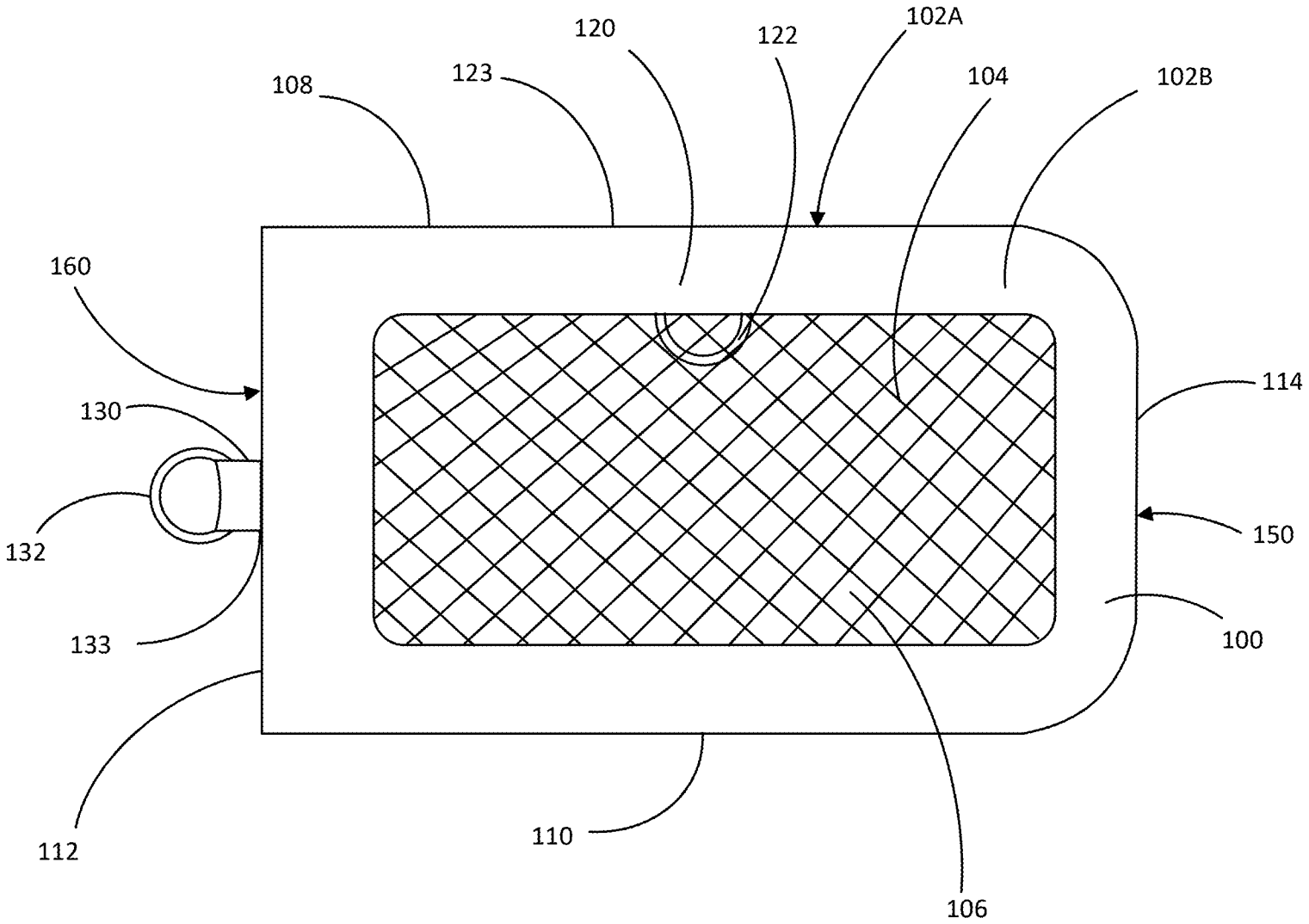
Figure 1D:
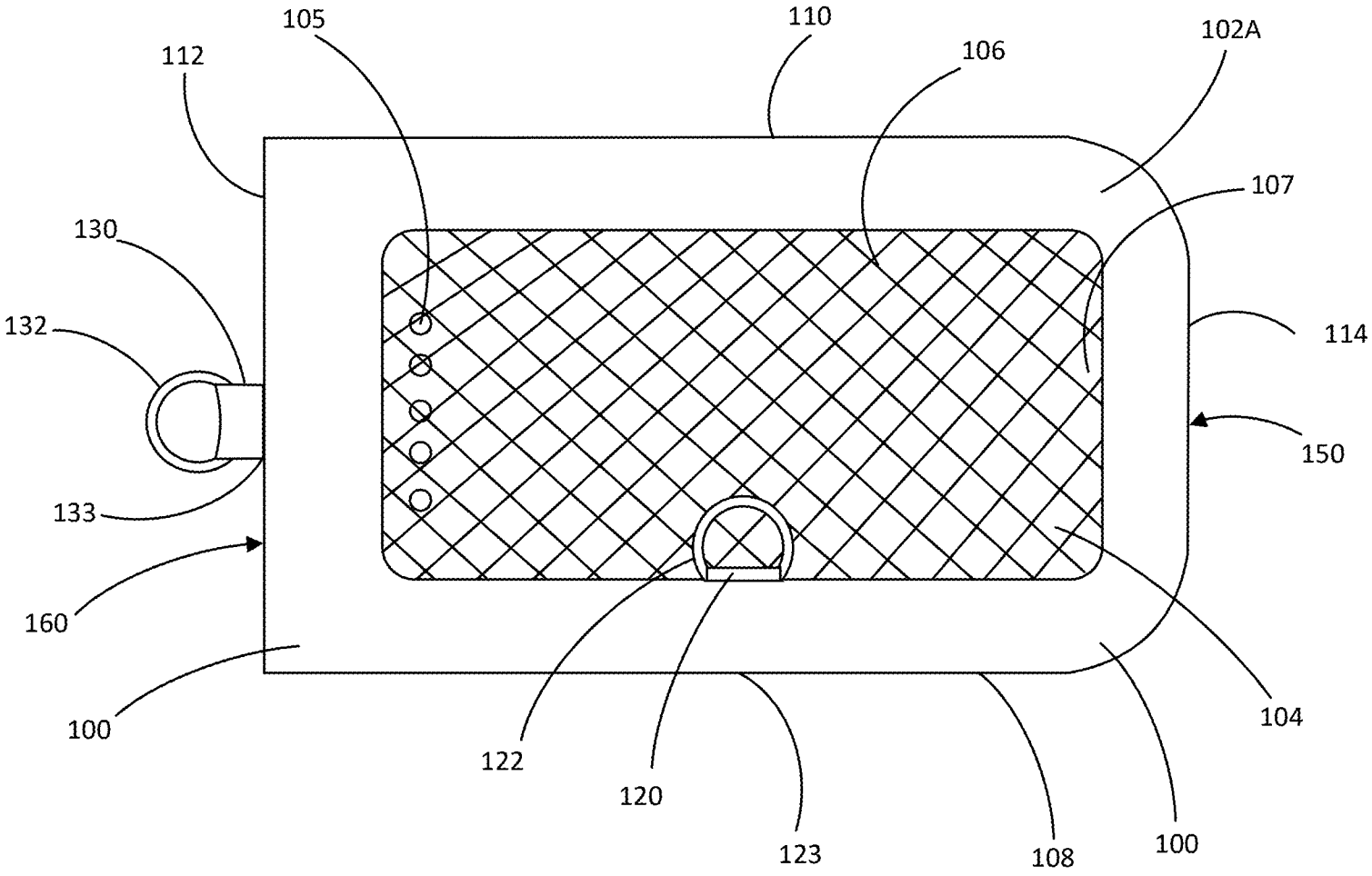

The storage apparatus 100 may also include a side tab 120 that is sown to the first pocket layer 102A and the second pocket layer 102B along first side 108. In some examples, the side tab 120 is sown between the first pocket layer 102A and the second pocket layer 102B. The side tab 120 includes an opening 124 through which a holding device, such as key ring 122, may be placed through. Further, side tab 120 may be inserted into the formed pocket through a side opening 123 (e.g., slot). For example, the side opening 123 may be through the second pocket layer 102B, and the side tab 120 may be folded down into the pocket through the side opening 123. As illustrated in FIGS. 1C and 1D, the side tab 120 is inserted through the side opening 123 and folds down into the pocket.

Figure 1E:
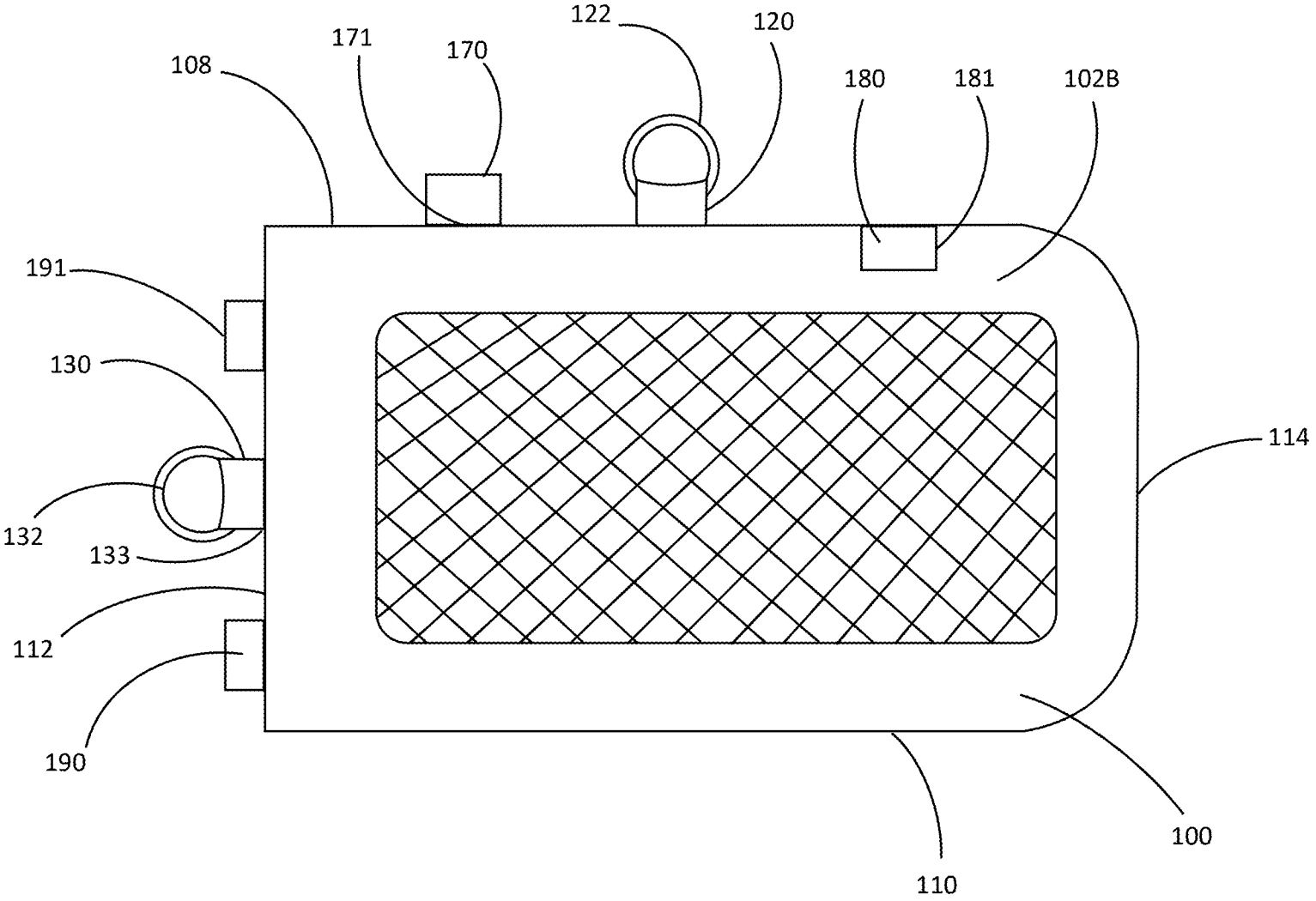
Figure 1F:
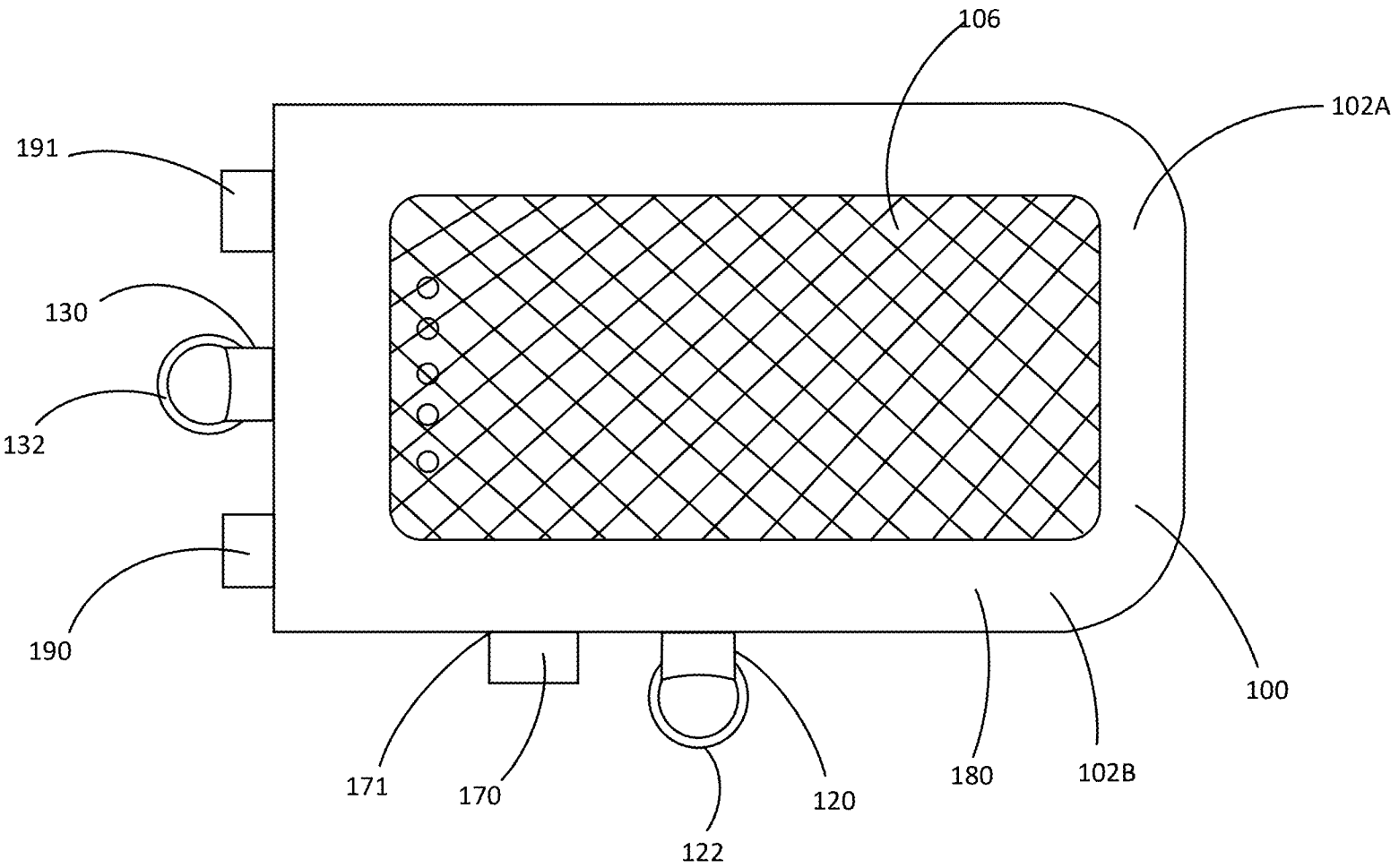

The storage apparatus 100 may include additional tabs either along the top side 114 or along the first side 108 and/or second side 110. For example, as illustrated in FIGS. 1E and 1F, storage apparatus 100 may include a second top tab 190 and a third top tab 191 along top side 112, each of which may be sown to the inside surface 133 of the second pocket layer 102B. Each of the second top tab 190 and the third top tab 191 may fold down into the pocket formed by the first pocket layer 102A and the second pocket layer 102B.

Additionally, the storage apparatus 100 may include a second side tab 170 and a third side tab 180 along the first side 108. Each of the second side tab 170 and the third side tab 180 may be sown to the first pocket layer 102A and the second pocket layer 102B along first side 108. In some examples, each of the second side tab 170 and the third side tab 180 are sown between the first pocket layer 102A and the second pocket layer 102B. Further, the second side tab 170 may be inserted into the formed pocket through a second side opening 171, and the third side tab 180 may be inserted into the formed pocket through a third side opening 181. FIGS. 1K and 1L further illustrate side tab 120, second side tab 170, and third side tab 180 protruding out through each of side openings 123, 171, and 181, respectively.

In some examples, some or all of the tabs 130, 190, 191, 120, 170, 180 may be attached to the inside surface 133 of the second pocket layer 102B using hook and loop material, glue, staples, or any other suitable attachment method.

The first pocket layer 102A, second pocket layer 102B, mesh backing 104, and any tabs (e.g., tabs 120, 130) may be manufactured from any textile or fabric material such as nylon, plastic, cotton, leather, vinyl leather, and faux leather, among other examples. The transparent cover 106 may be manufactured from any transparent material, such as plastic, glass, polycarbonate, transparent ceramic, transparent fabric, or any other suitable material. In some examples, the top side 112 and bottom side 114 may have a width of between 4 inches and 6 inches (e.g., 4.5 inches). In some examples, the first side 108 and the second side 110 may have a width between 6 inches and 8 inches (e.g., 7 inches).

Figure 1G:
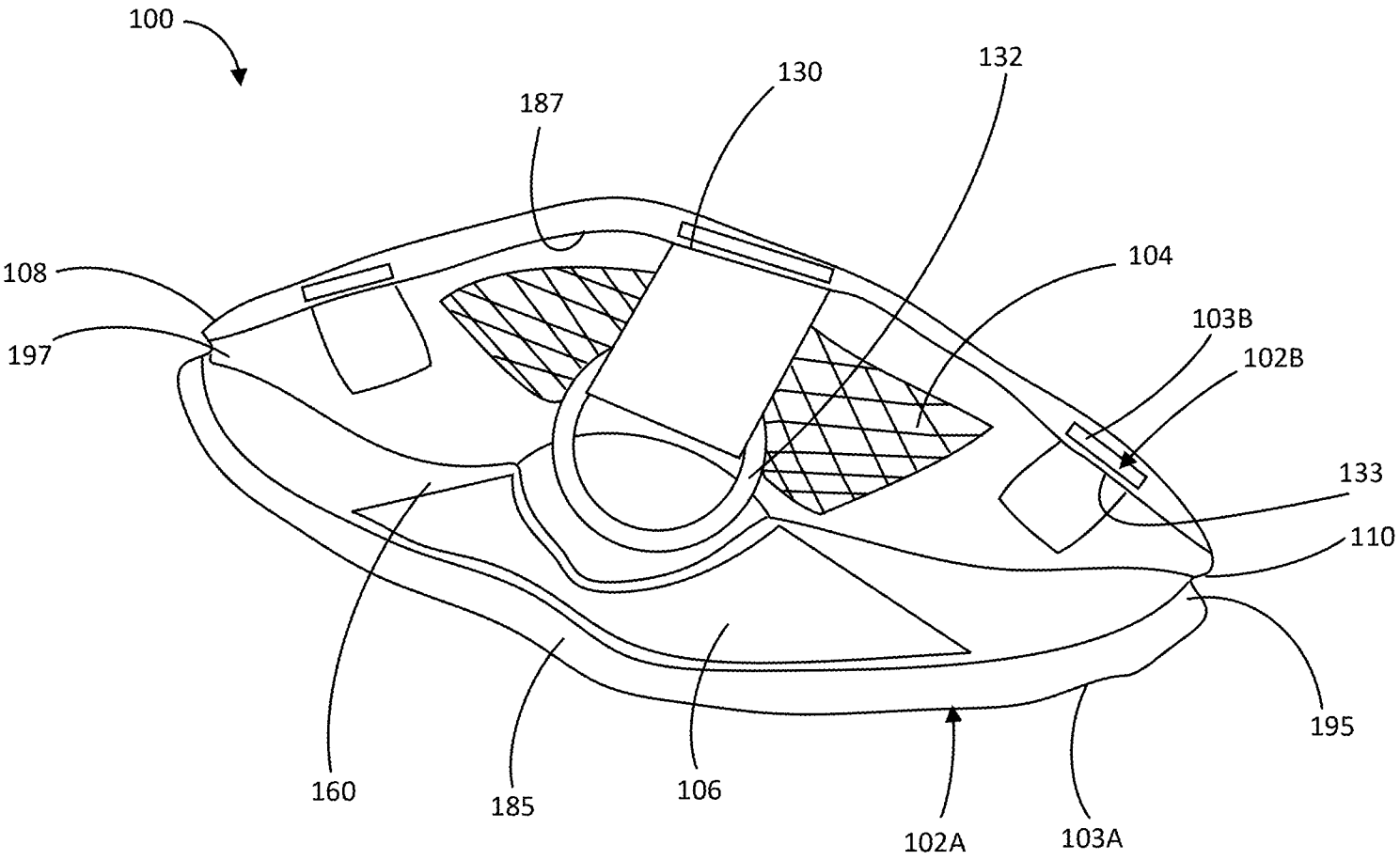
Figure 1H:
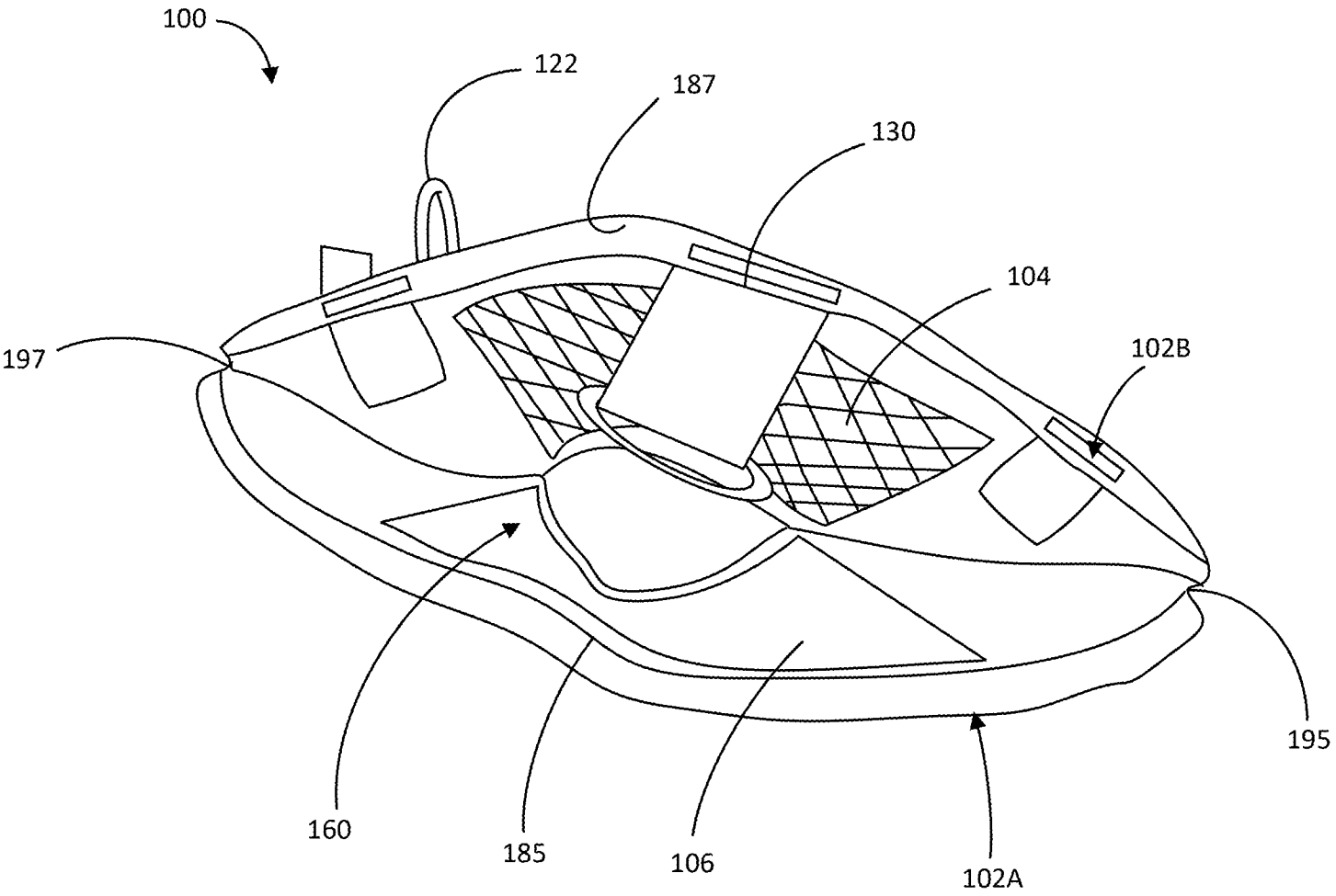
Figure 1I:
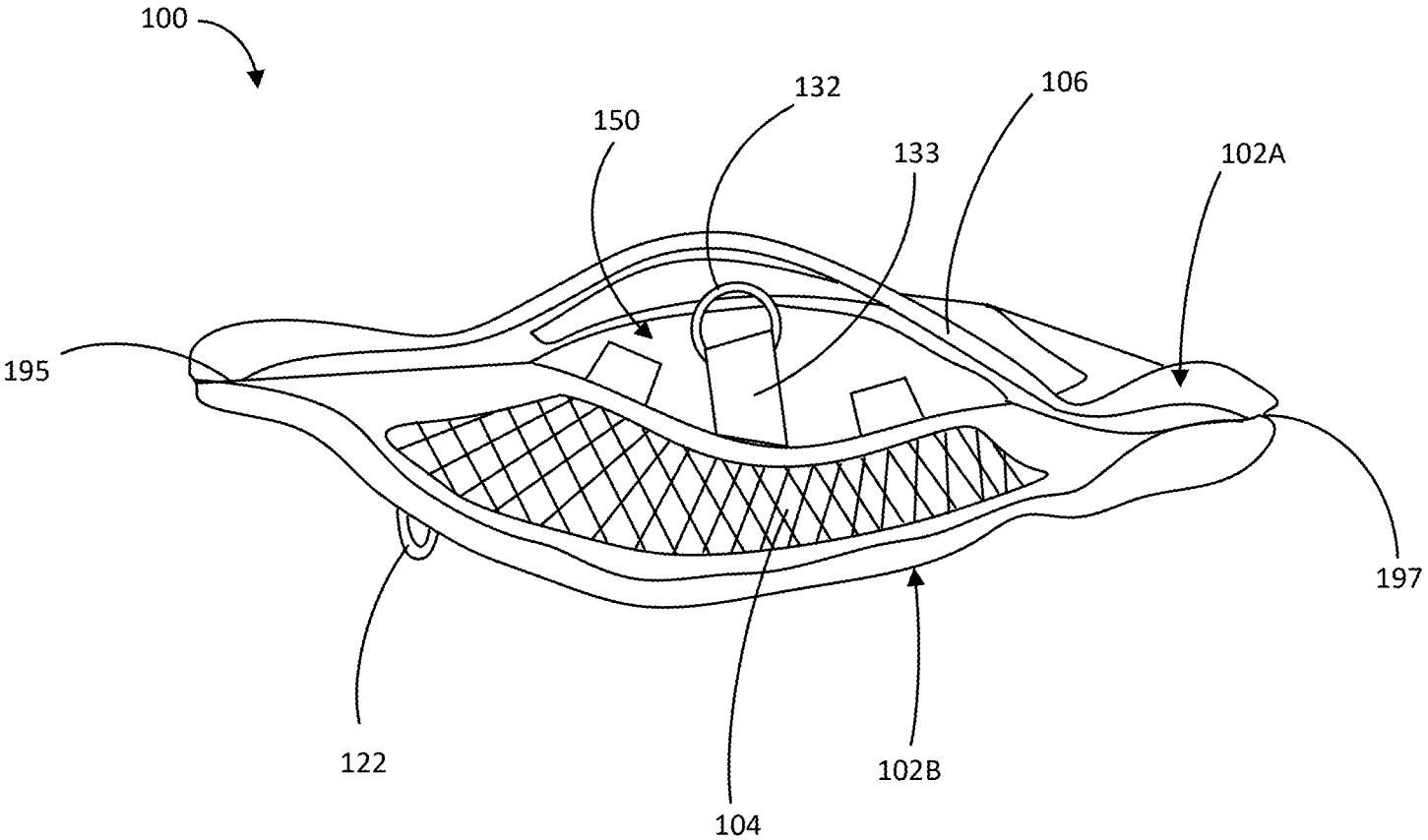
Figure 1J:
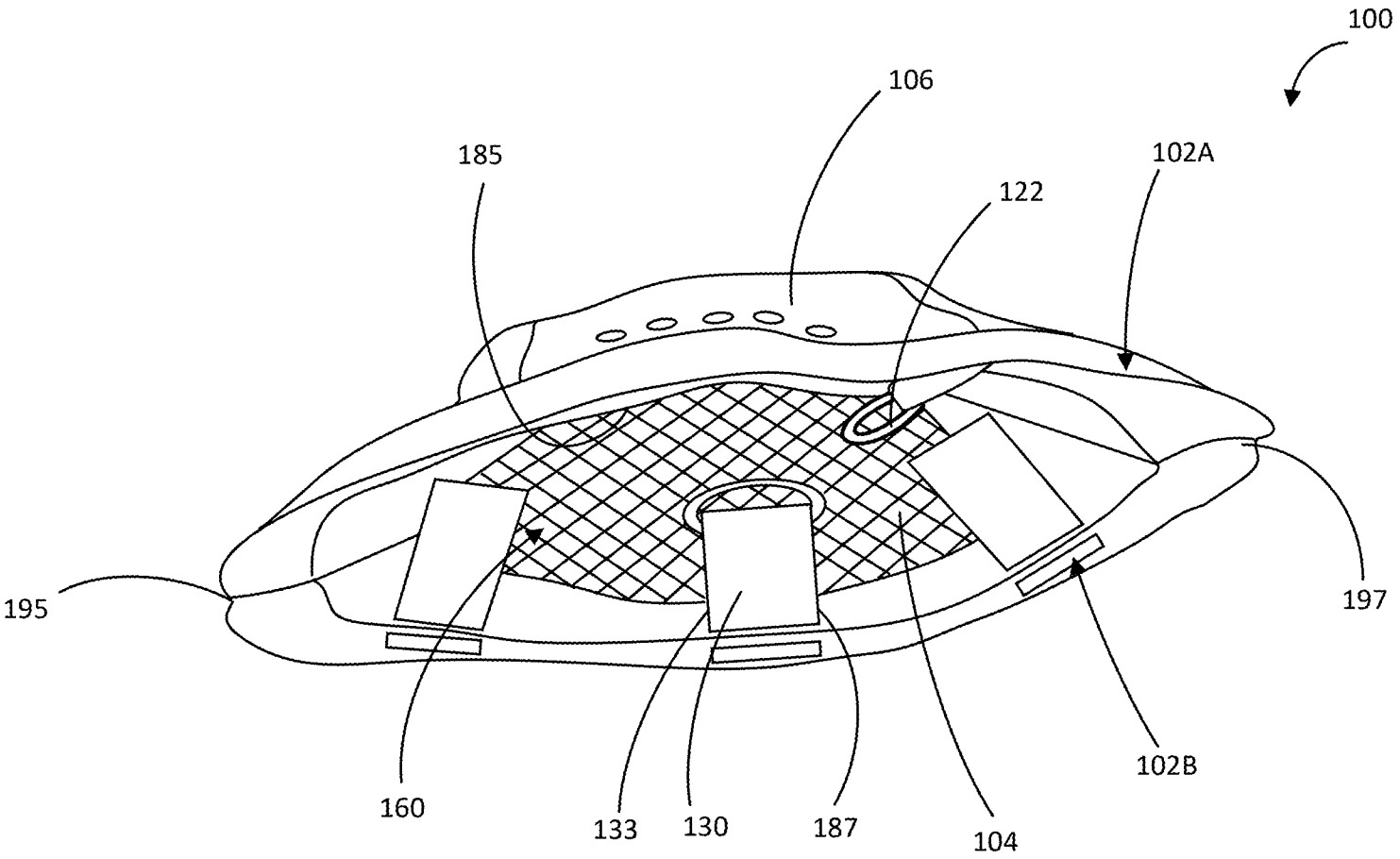
Figure 1K:
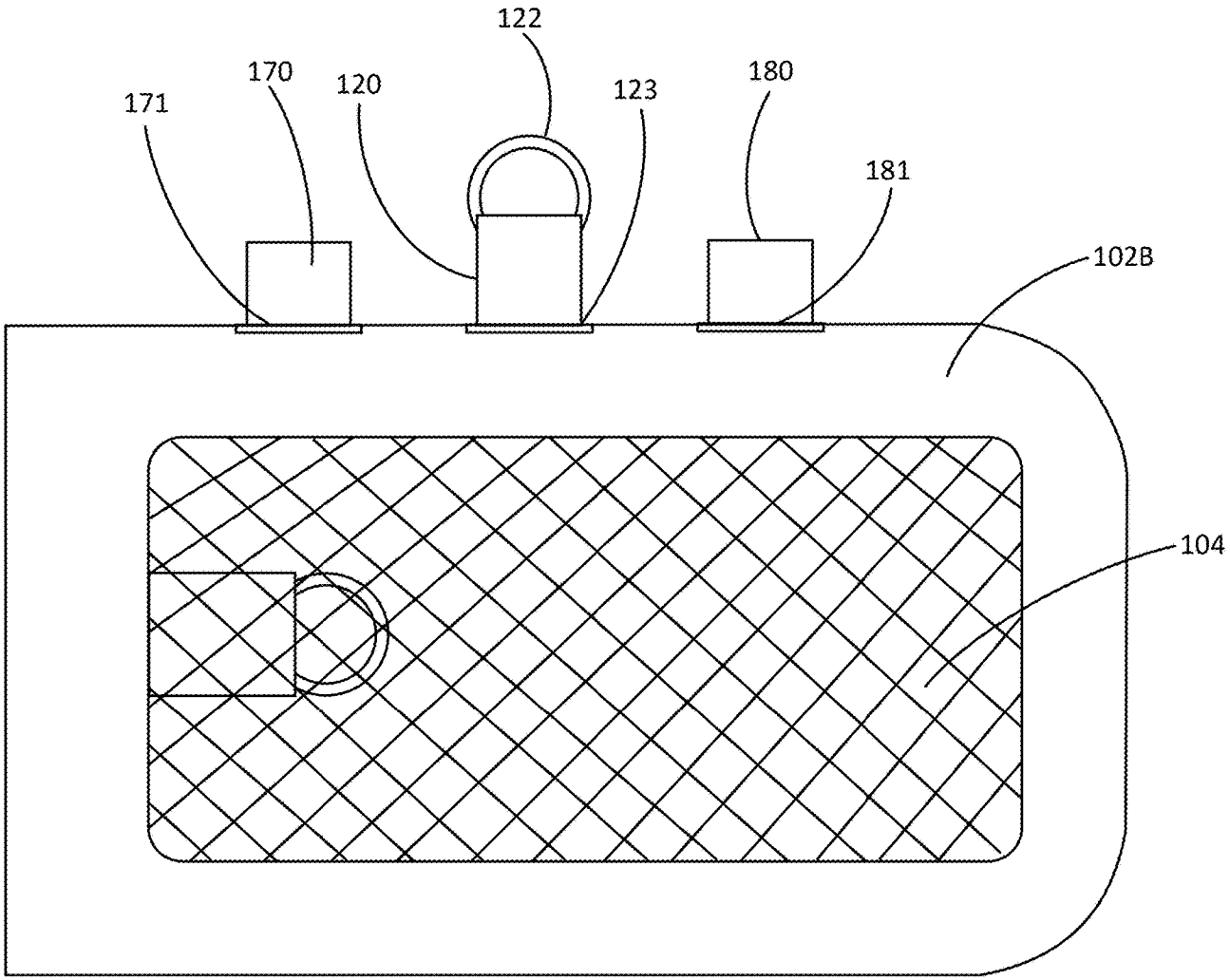
Figure 1L:
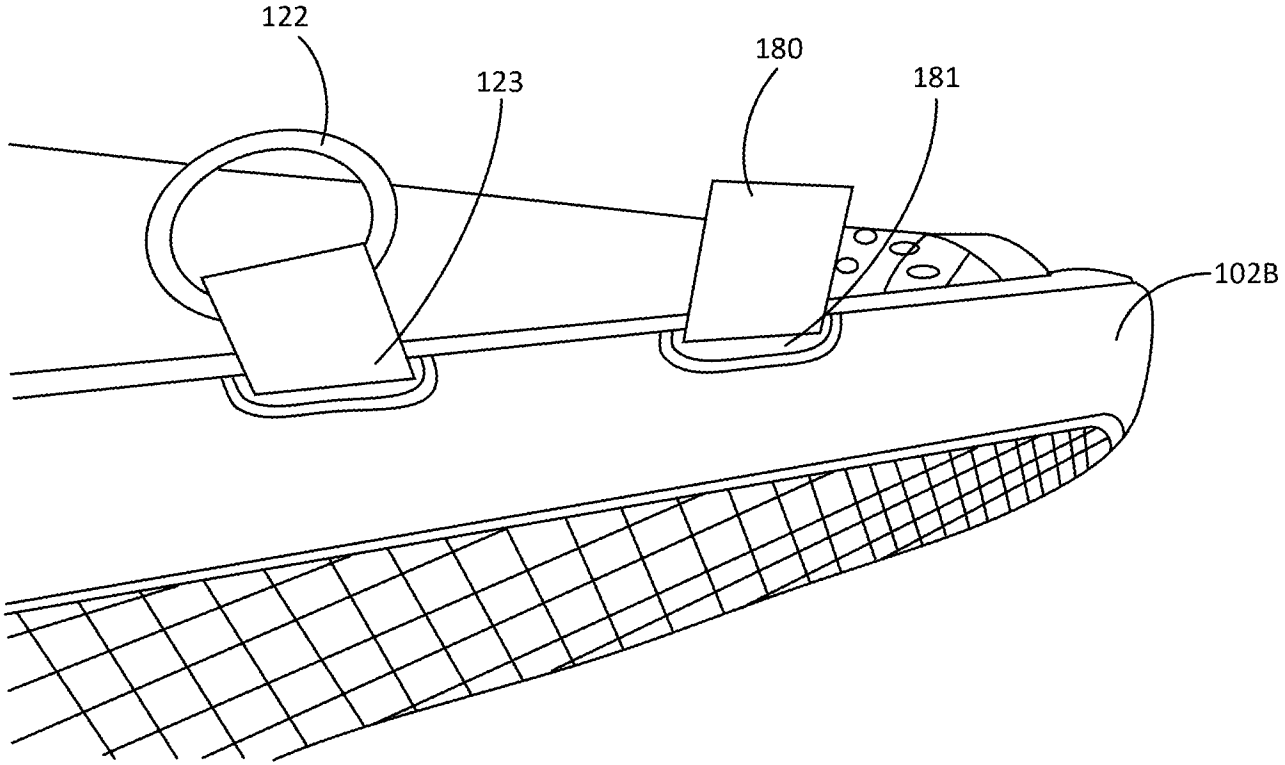

FIGS. 1G, 1H, and 1J illustrate a view into the first opening 160 of the storage apparatus 100. As illustrated, first pocket layer 102A may include hook and loop material 185 (e.g., hook material) near a top edge 103A of its inside surface, and second pocket layer 102B may include hook and loop material 187 (e.g., loop material) near a top edge of its inside surface 133. As such, hook and loop materials 185, 187 allow for the securing (e.g., sealing) of first opening 160 when the area near the top edge 103A of the first pocket layer 102A is put in contact with (e.g., pressed to) the area near the top edge 103B of the second pocket layer 102B. In addition, as illustrated, first pocket layer 102A is sown to second pocket layer 102B along a first seam 197 that runs along the first side 108, as well as along a second seam 195 that runs along the second side 110. FIG. 1I illustrates a view into the second opening 150 of the storage apparatus 100.

FIGS. 2A, 2B, 2C, 2D, 2E, 2F, and 2G illustrate a storage apparatus 200 that includes a first pocket layer 202A and a second pocket layer 202B that define a first pocket with a first opening 260 and, in some examples, a second opening 250. The storage apparatus 200 also includes a third pocket layer 202C. The second pocket layer 202B and the third pocket layer 202C define a second pocket with an opening 261. The first pocket layer 202A is sown (e.g., stitched) to the second pocket layer 202B and the third pocket layer 202C along a first side 208 as well as along a second side 210 opposite the first side 208. The first pocket layer 202A may also be sown to the second pocket layer 202B and the third pocket layer 202C along a bottom side 214. The first opening 260 may extend along a top side 212 of the storage apparatus 200. In some examples, a width of the first opening 260 is between 75% and 95% of the width of the top side 212. The second opening 250 may extend along a bottom side 214 of the storage apparatus 200. In some examples, a width of the second opening 250 is between 15% and 35% of the width of the bottom side 214.

Further, the first pocket layer 202A may be sown to a transparent cover 206, such as with stitching 285. The transparent cover 206 allows for the viewing of an item, such as a document or smartphone, that is secured within the storage apparatus 200. For example, a user may provide input to a smartphone secured within the storage apparatus 200 through the transparent cover 206. The transparent cover 206 may include one or more apertures 205, 207.

The storage apparatus 200 may further include a top tab 240 that is sown to a surface 243 of the second pocket layer 202B (i.e., the side of the second pocket layer 202B facing the formed first pocket, or the side of the second pocket layer 202B facing the formed second pocket) along the top side 212. The top tab 250 may include an opening 244 whereby a holding device, such as key ring 242, may be placed through the opening 244. The top tab 240, while semi-rigid, is flexible and can fold into the first opening 260.

The storage apparatus 200 may also include a side tab 270 that is sown to the second pocket layer 202B along first side 208. In some examples, the side tab 270 is sown between the first pocket layer 202A and the second pocket layer 202B. The side tab 270 includes an opening through which a holding device, such as key ring 272, may be placed through. Further, side tab 270 may be inserted into the formed second pocket through a side opening 273 (e.g., slot). For example, the side opening 273 may be through the third pocket layer 202C, and the side tab 270 may be folded down into the second pocket through the side opening 273. The side tab 270 may be inserted through the side opening 273 and folds down into the pocket.

The storage apparatus 200 may include additional tabs either along the top side 214 or along the first side 208 and/or second side 210. For example, storage apparatus 200 may include a second top tab 232 and a third top tab 230 along top side 212, each of which may be sown to a surface 243 of the second pocket layer 102B. The surface 243 may be the surface of the second pocket layer 102B facing the second pocket formed by the second pocket layer 202B and the third pocket layer 202C. Each of the second top tab 232 and the third top tab 230 may fold down into the second pocket formed by the second pocket layer 202B and the third pocket layer 202C.

Additionally, the storage apparatus 200 may include a second side tab 250 and a third side tab 254 along the first side 208. Each of the second side tab 250 and the third side tab 254 may be sown to one or more of the first pocket layer 202A, the second pocket layer 202B, and the third pocket layer 202C along first side 208. In some examples, each of the second side tab 250 and the third side tab 254 are sown between the second pocket layer 202B and the third pocket layer 202C. Further, the second side tab 250 may be inserted into the formed second pocket through a second side opening 257, and the third side tab 254 may be inserted into the formed second pocket through a third side opening 255. Additionally, the second side tab 250 may be folded down into the second side opening 257, and the third side tab 254 may be folded down into the third side opening 255.

In some examples, some or all of the tabs 240, 230, 232, 250, 270, 254 may be attached to the surface 233 of the second pocket layer 202B using hook and loop material, glue, staples, or any other suitable attachment method. For example, stitching 281, 283 may secure hook and loop material to first pocket layer 202A and third pocket layer 202C.

The first pocket layer 202A, second pocket layer 202B, third pocket layer 202C, and any tabs (e.g., tabs 240, 230, 232, 250, 270, 254) may be manufactured from any textile or fabric material such as nylon, plastic, cotton, leather, vinyl leather, and faux leather, among other examples. The transparent cover 206 may be manufactured from any transparent material, such as plastic, glass, polycarbonate, transparent ceramic, transparent fabric, or any other suitable material. In some examples, the top side 212 and bottom side 214 may have a width of between 4 inches and 6 inches (e.g., 4.5 inches). In some examples, the first side 208 and the second side 210 may have a width between 6 inches and 8 inches (e.g., 7 inches).

Figure 2A:
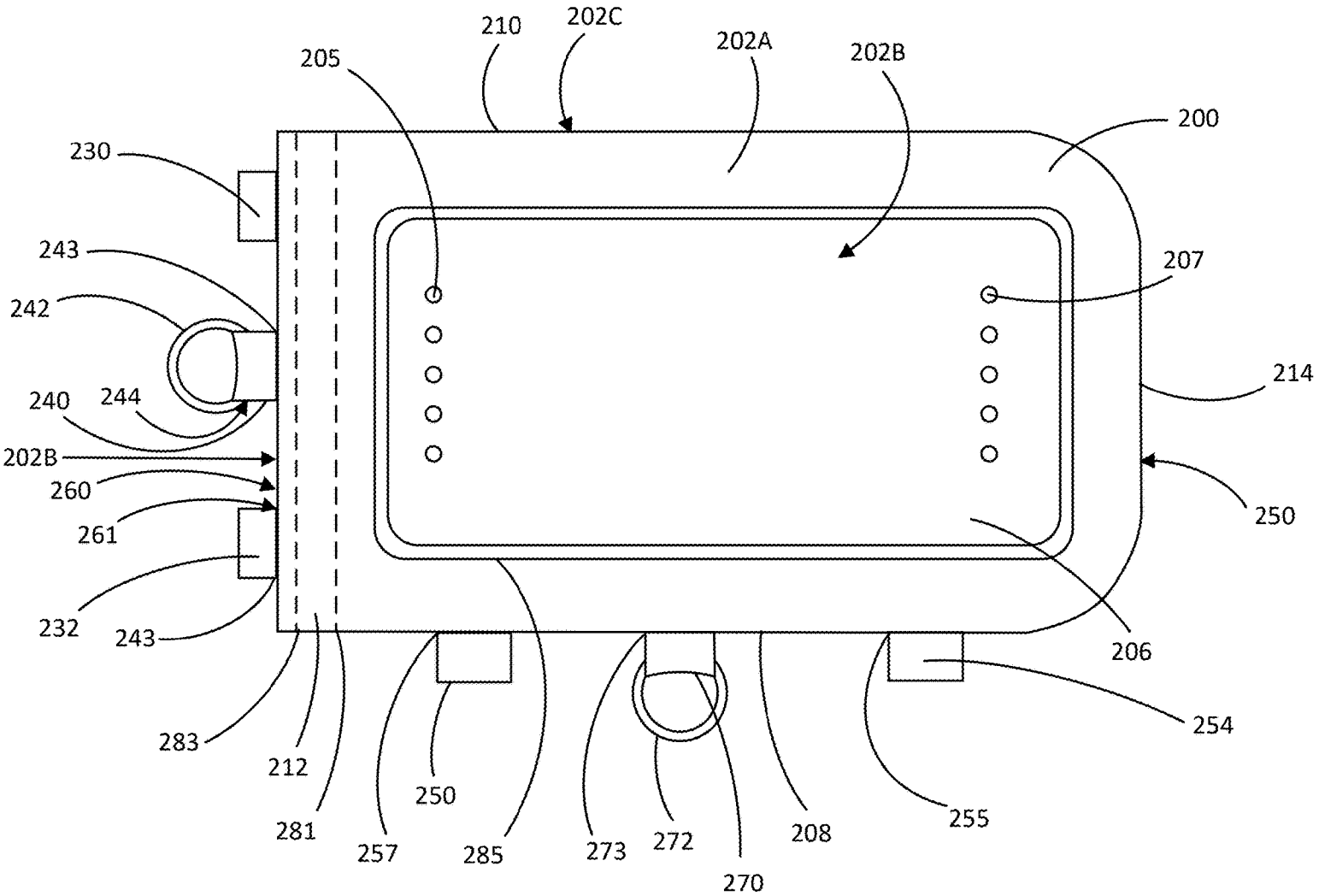
FIGS. 2A, 2B, 2C, 2D, 2E, 2F, and 2G illustrate a storage apparatus with multiple pockets and multiple tabs, in accordance with some embodiments.
Figure 2B:
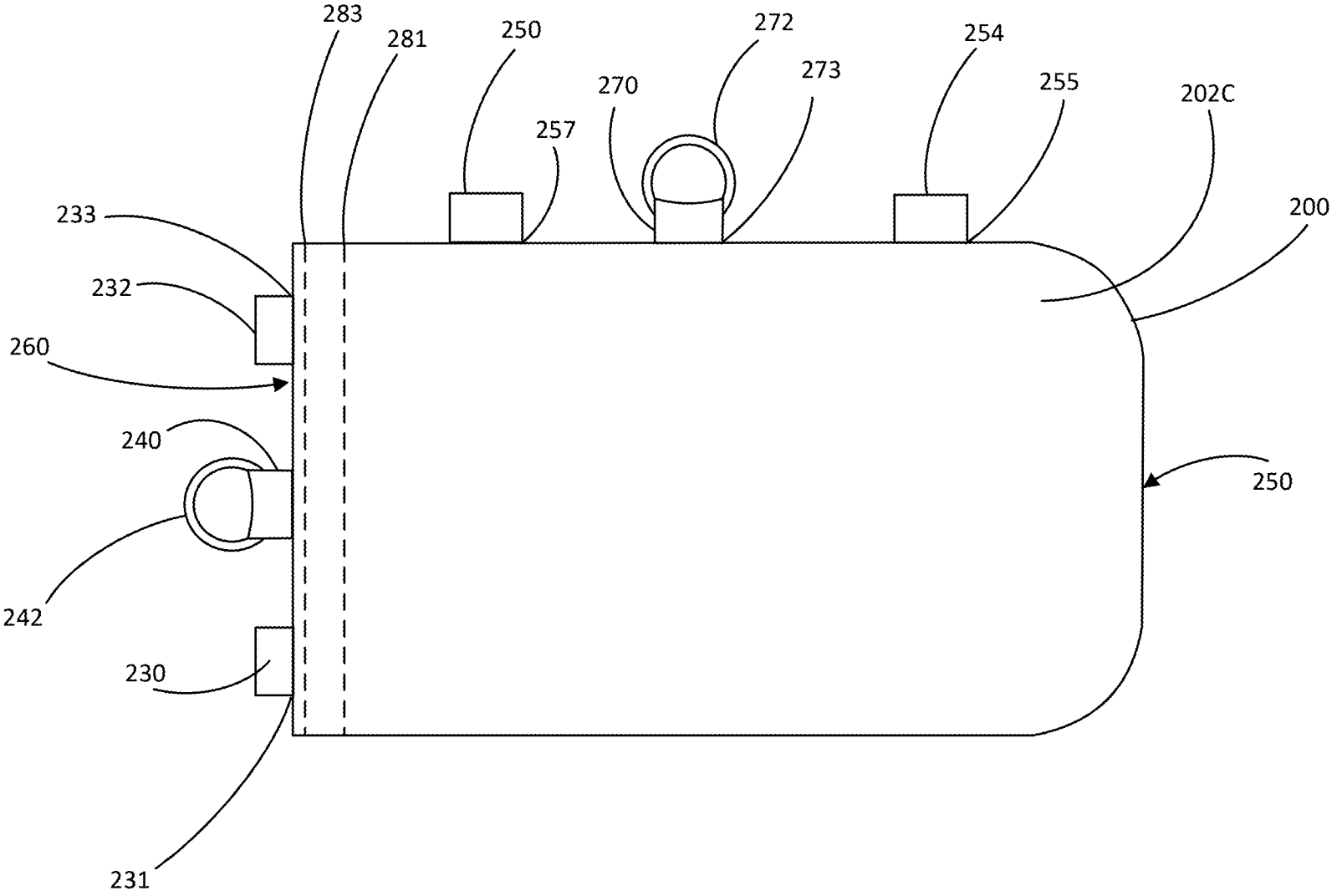
Figure 2C:
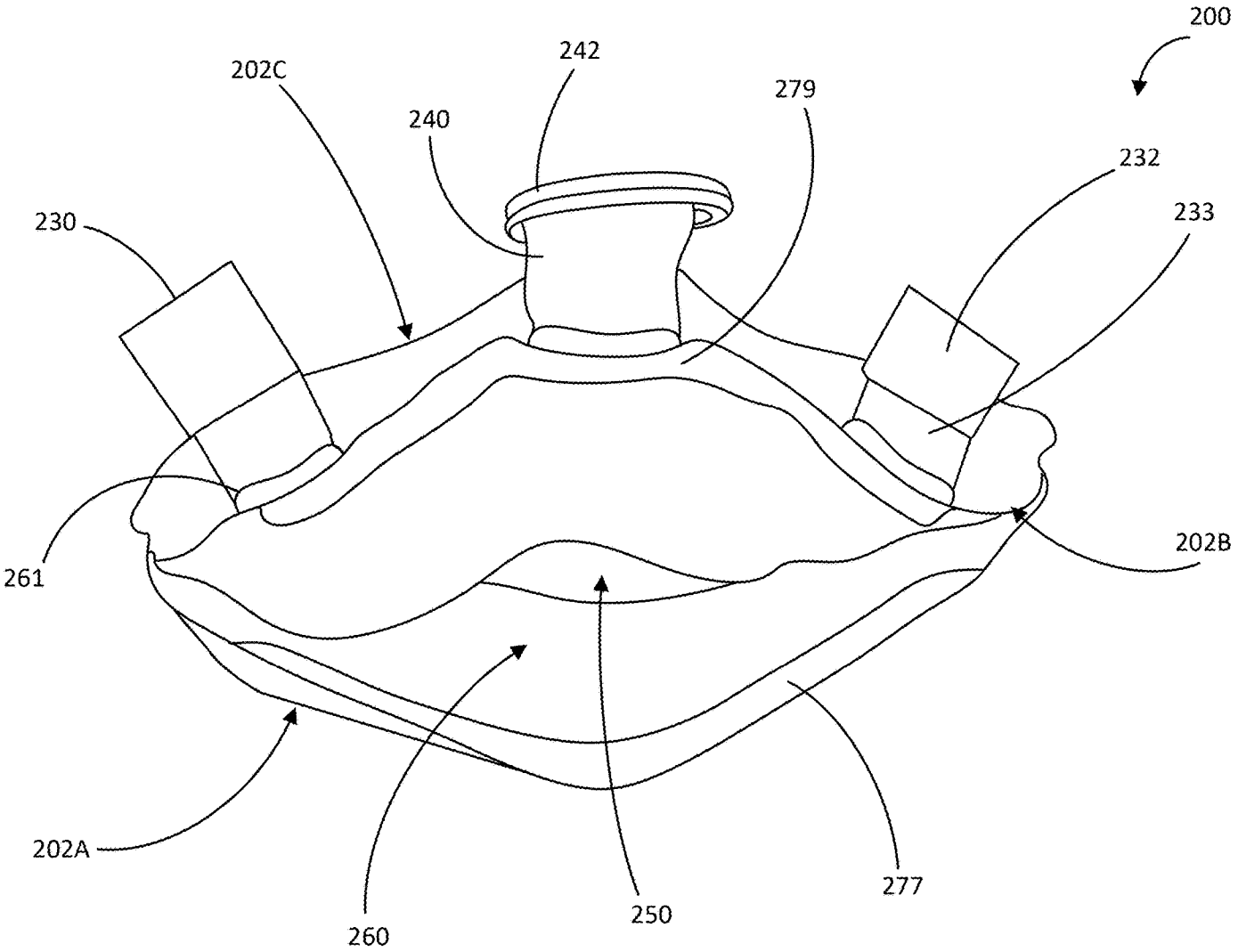
Figure 2D:
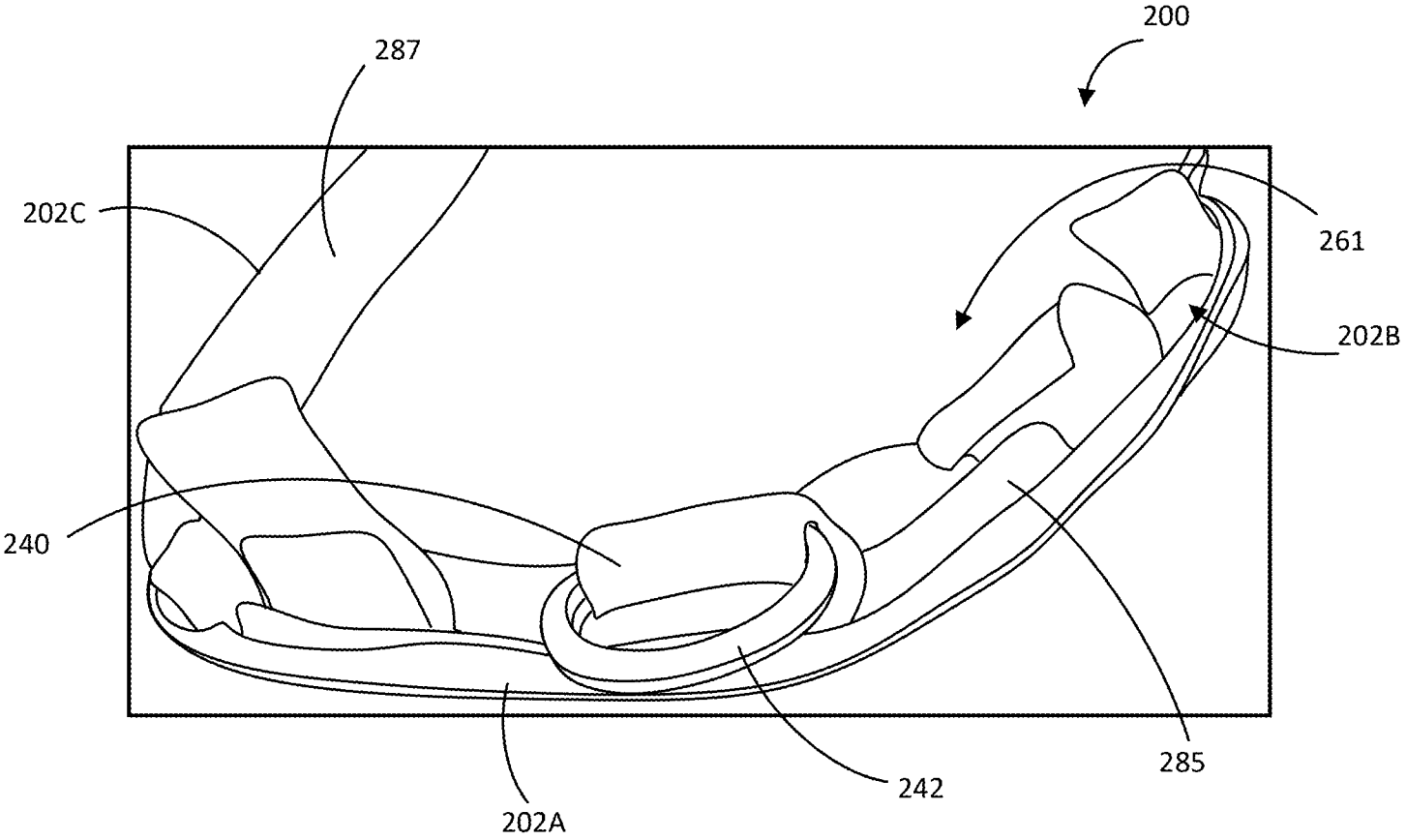
Figure 2E:
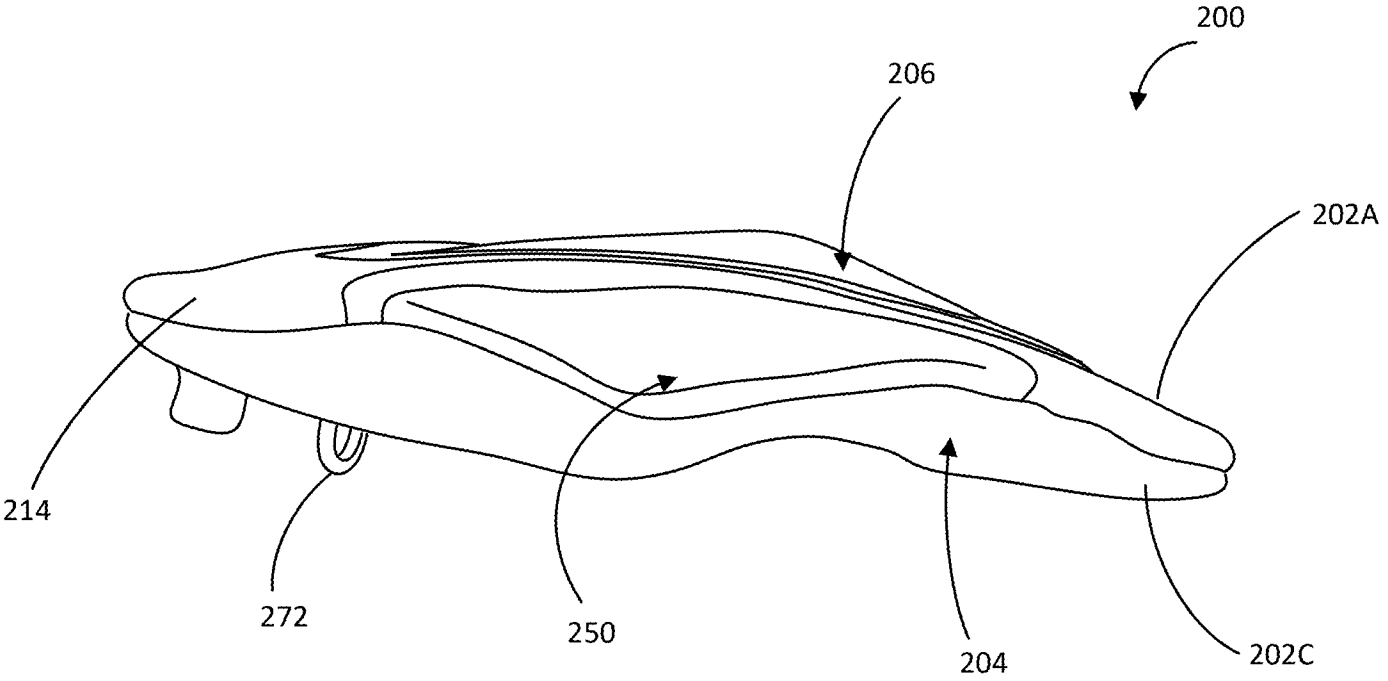

FIG. 2C illustrates a view into the first opening 260, while FIG. 2D illustrates a view into the third opening 261. FIG. 2E illustrates a view into the second opening 250.

Figure 2F:
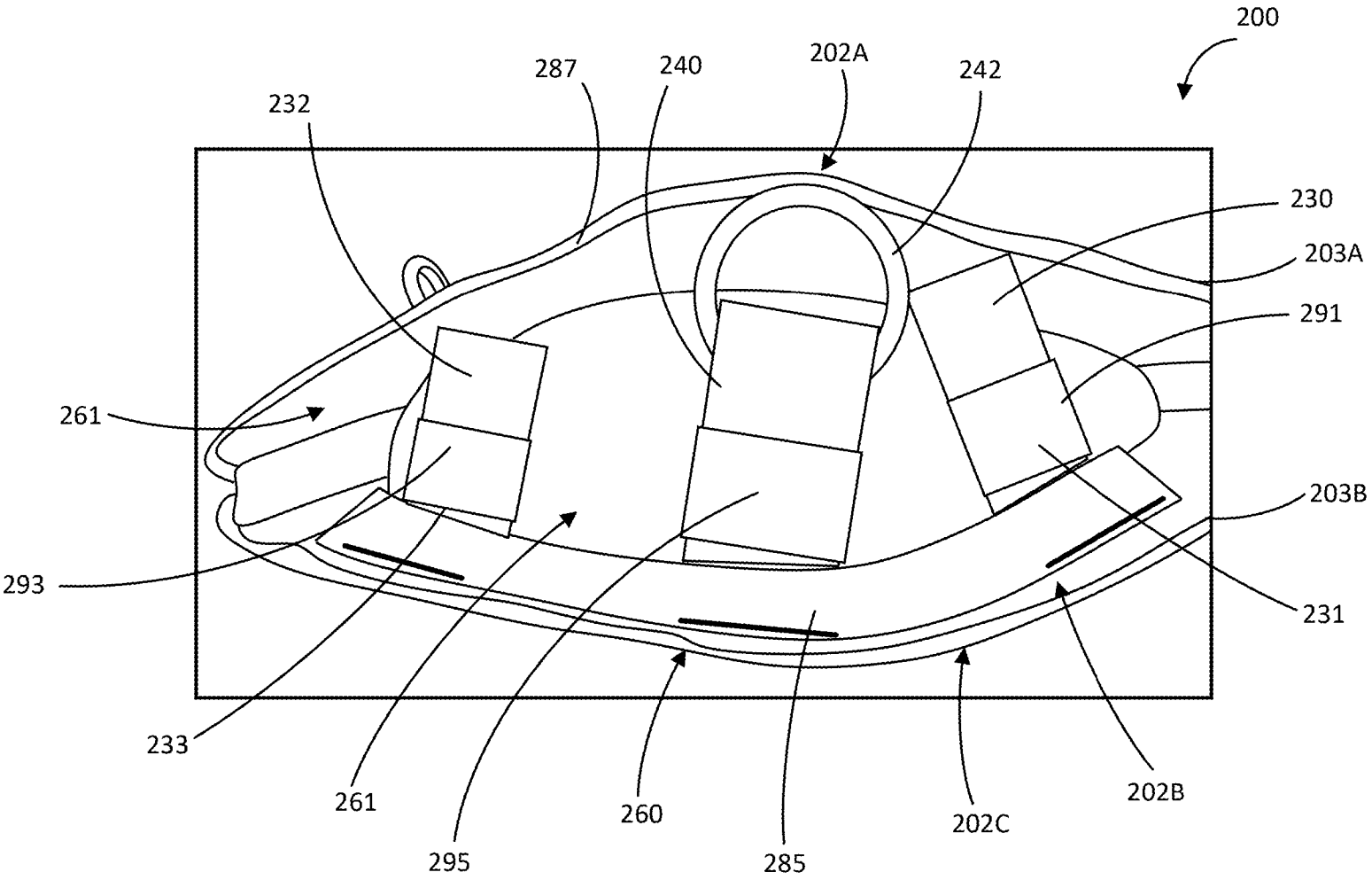
Figure 2G:
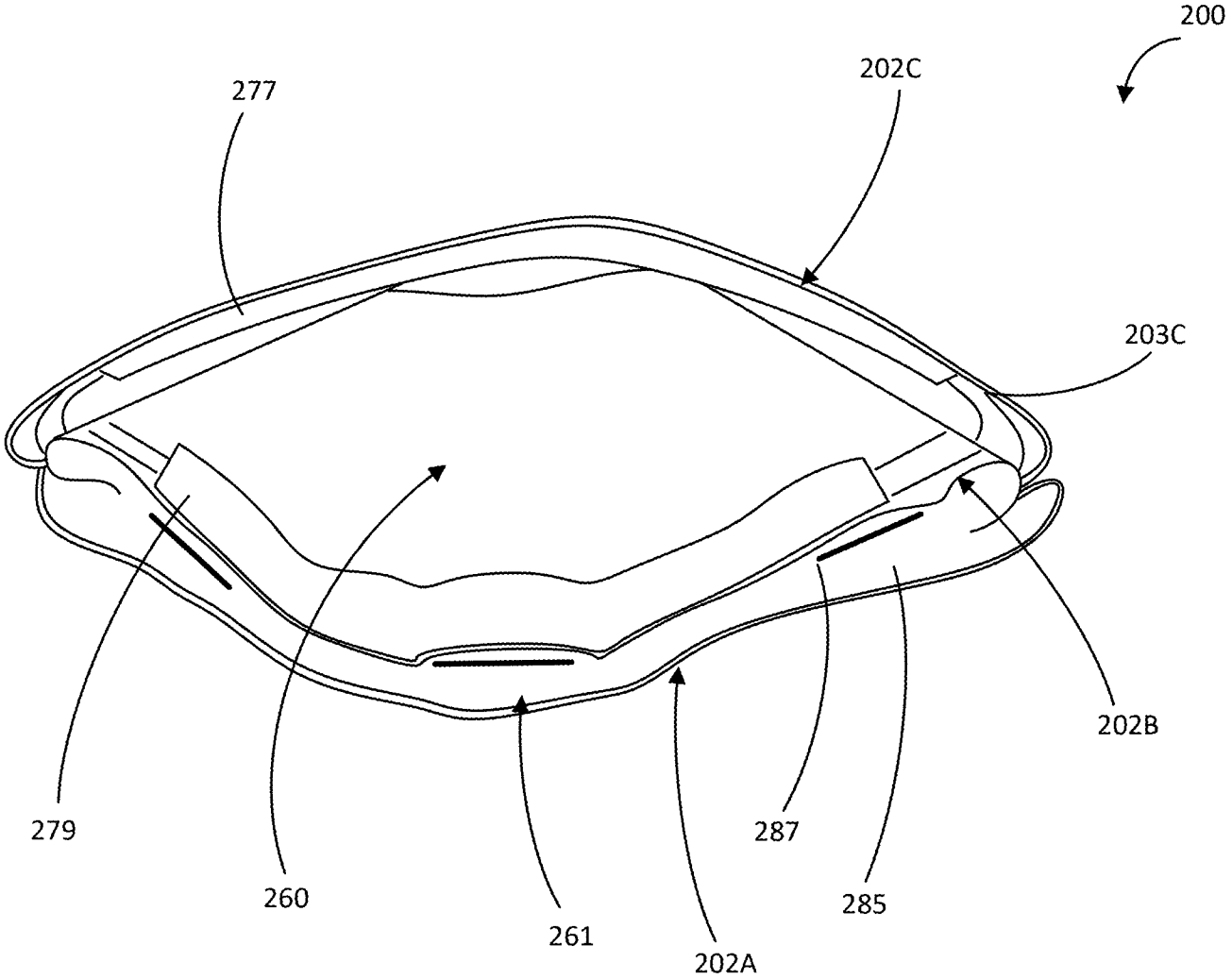
Figure 3A:
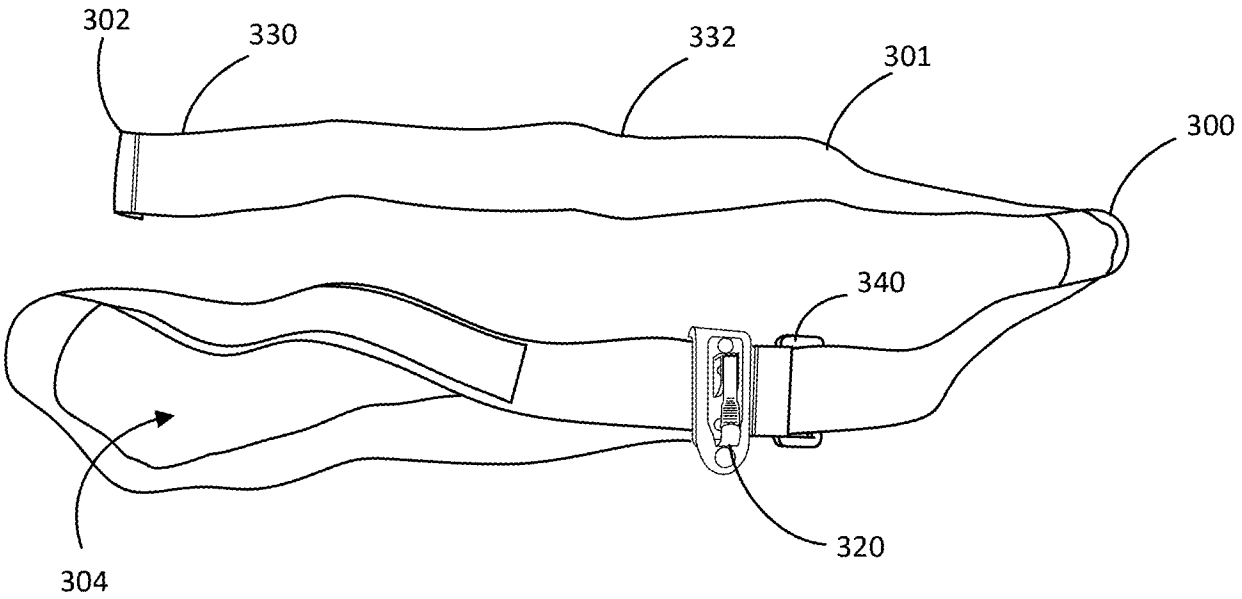
FIGS. 3A, 3B, 3C, and 3D illustrate a belt apparatus, in accordance with some embodiments.
Figure 3B:
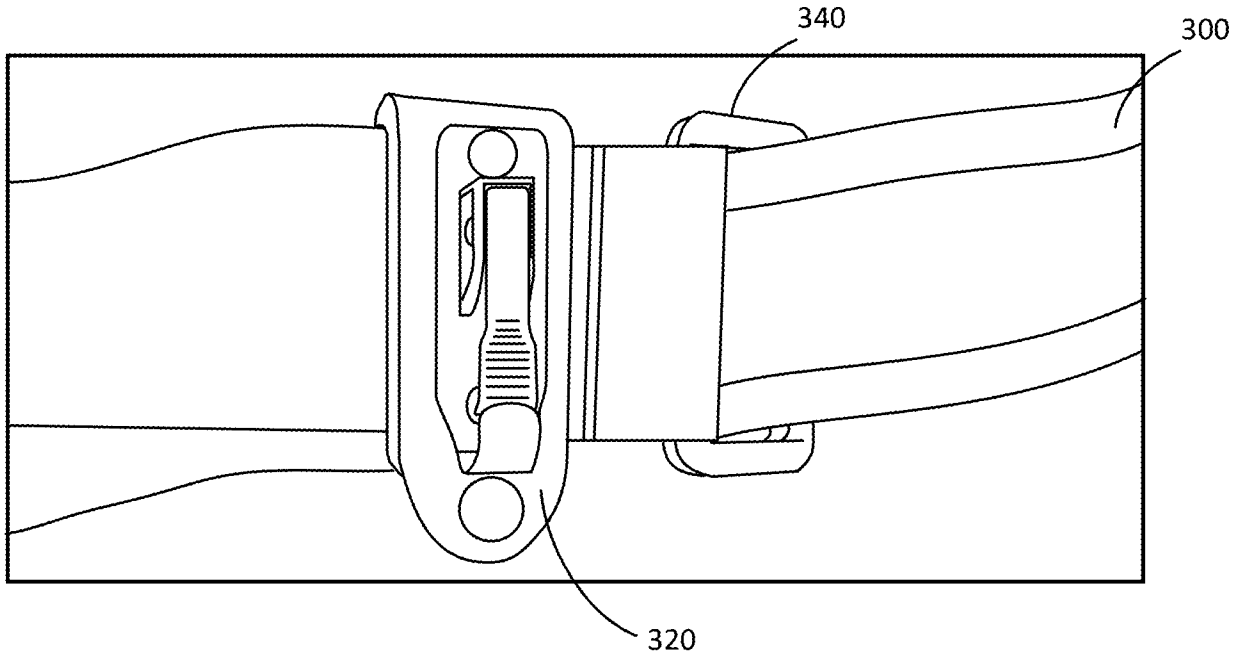
Figure 3C:
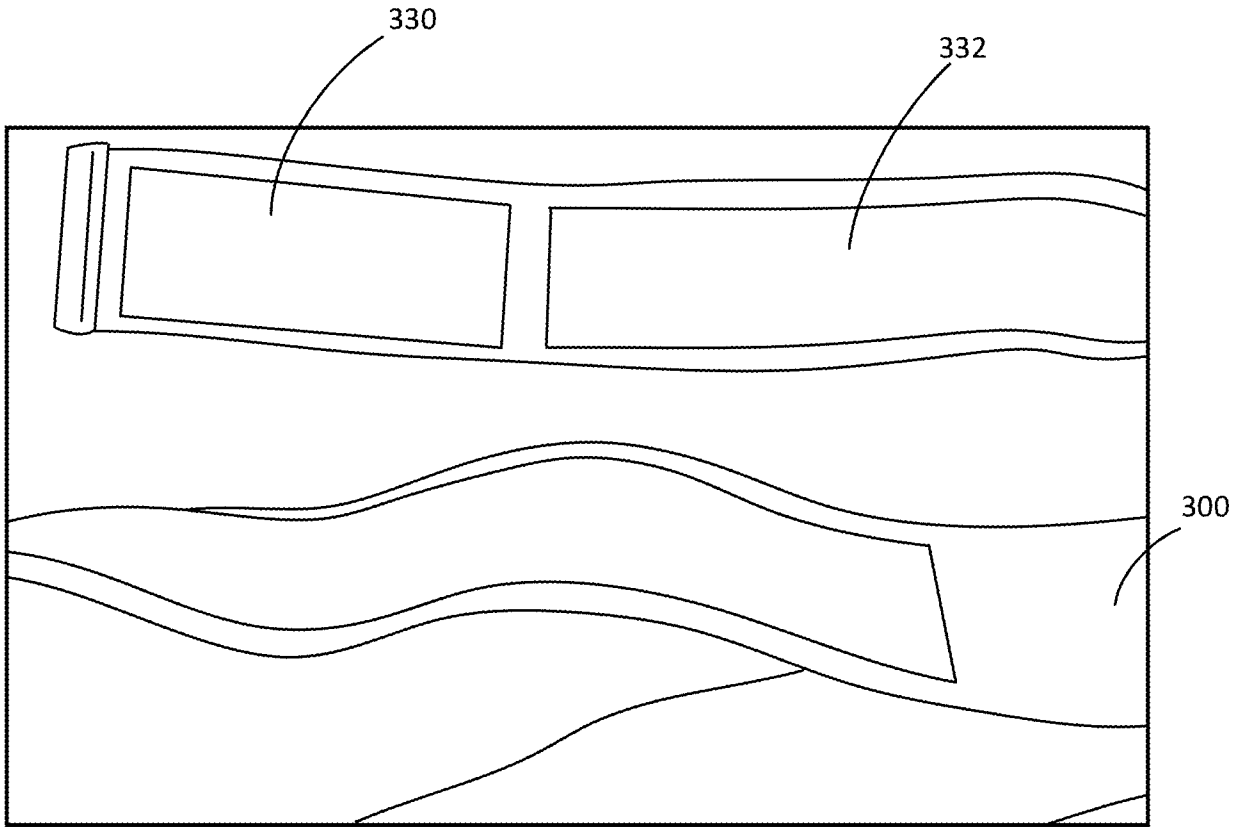
Figure 3D:
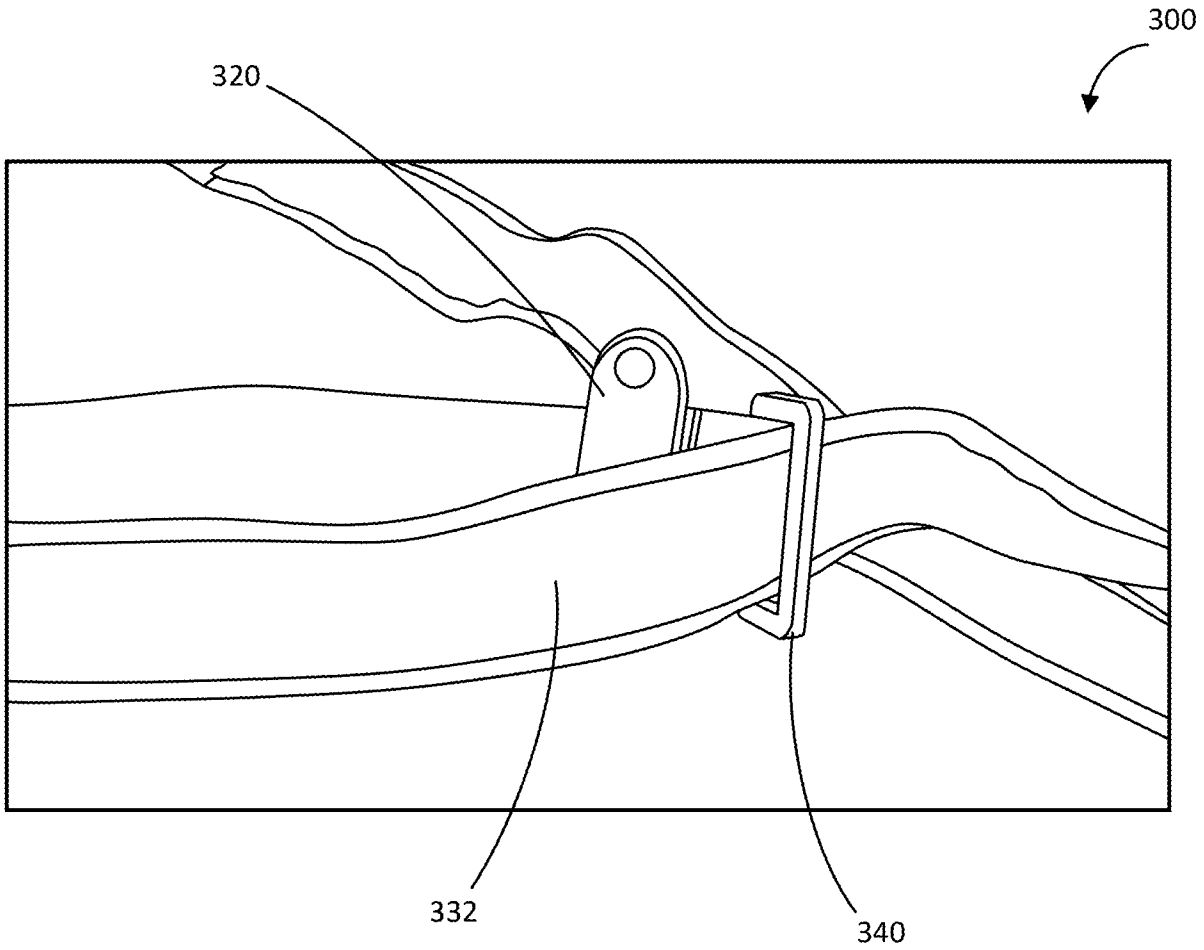

With reference to FIGS. 2D and 2F, first pocket layer 202A may include hook and loop material 287 (e.g., hook material) near a top edge 203A of its inside surface, and second pocket layer 202B may include hook and loop material 285 (e.g., loop material) near a top edge 203B of its inside surface 233. As such, hook and loop materials 285, 287 allow for the securing of the third opening 261 when the area near the top edge 203A of the first pocket layer 202A is put in contact with (e.g., pressed to) the area near the top edge 203B of the second pocket layer 202B. Similarly, as illustrated in FIGS. 2C and 2G, second pocket layer 202B may include hook and loop material 279 on a side facing the first pocket 260 such that, when pressed with hook and loop material 277 near a top edge 203C of the third pocket layer 202C, secures (e.g., seals) second pocket layer 202B to third pocket layer 202C.

FIGS. 3A, 3B, 3C, and 3D illustrate a belt apparatus 300 that includes a belt portion 301 with hook and loop material 330 (e.g., hook material) near an end 302 of the belt portion 301, and hook and loop material 332 (e.g., loop material) spaced from the hook and loop material 330 and extending laterally along the belt portion 301. Further, the belt apparatus 300 includes a holding clip 320 and a tightening clip 330. Each of the holding clip 320 and tightening clip 330 slide onto the belt portion 301. The holding clip 320 may secure, for instance, storage apparatus 100, storage apparatus 200, storage apparatus 400, or card apparatus 600 (storage apparatus 400 and card apparatus 600 are discussed below). Further, by sliding the tightening clip 330 along the belt portion 301, a circumference of a formed loop 304 may be increased or decreased. Moreover, the end 302 of the belt portion 301 may be folded over the tightening clip 330 such that hook and loop material 330 engages with at least a portion of hook and loop material 332 to secure the belt apparatus 300 to, for example, a person's waist.

Figure 4A:
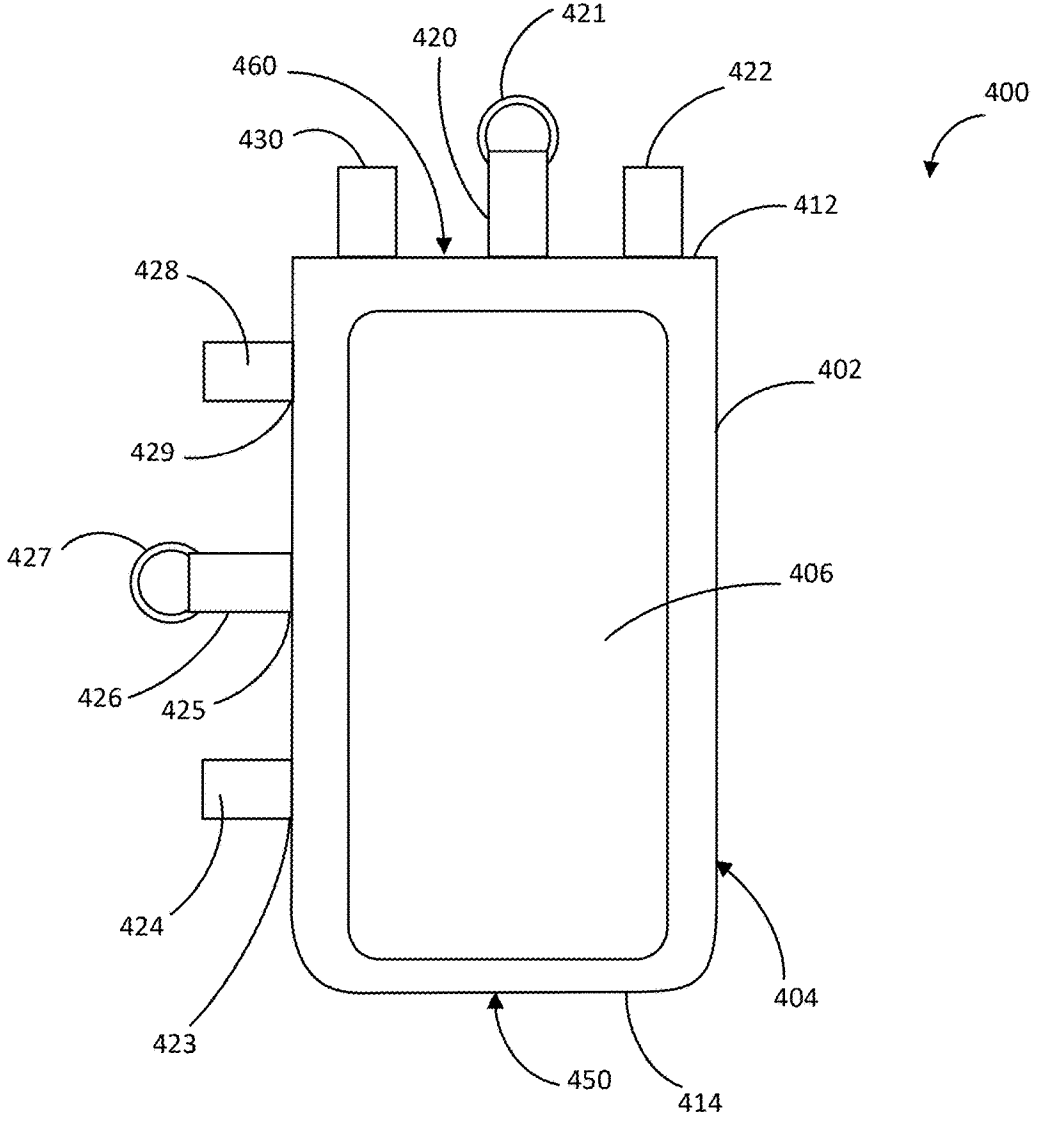
FIGS. 4A and 4B illustrate a storage apparatus with multiple tabs, in accordance with some embodiments.
Figure 4B:
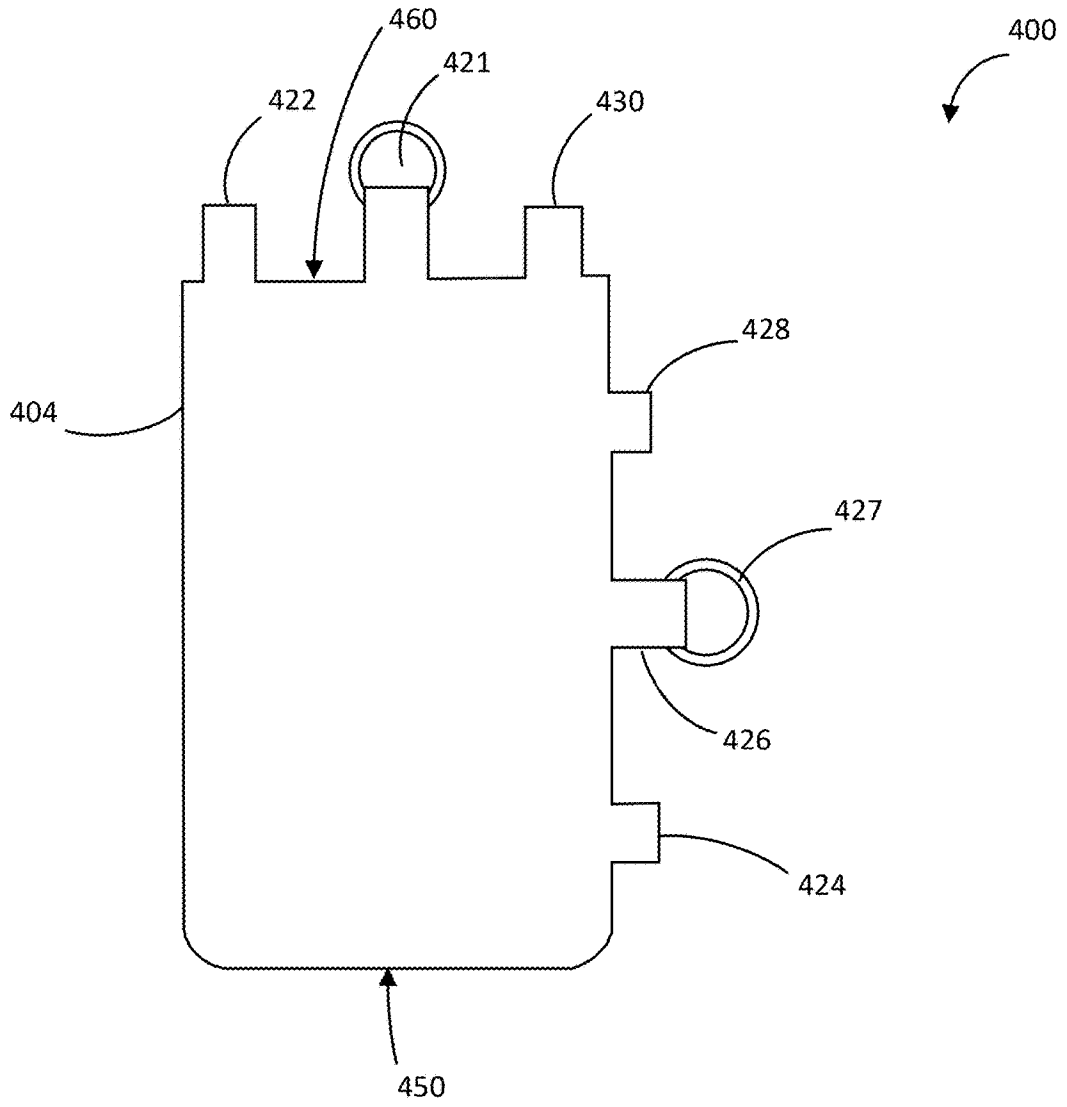

FIGS. 4A and 4B illustrate a storage apparatus 400 that includes a first pocket layer 402 coupled to a second pocket layer 404 that define a pocket. The first pocket layer 402 may be secured to the second pocket layer 404 using stitching, glue, staples, hook and loop material, or by any other suitable means. A transparent cover 406 may be secured to the first pocket layer 402 (e.g., via stitching, glue, hook and loop material, etc.). The transparent cover 406 may allow for the display of documents or smart devices that may be placed into the formed pocket.

In addition, the first pocket layer 402 and second pocket layer 404 define a first opening 460 and a second opening 450, where the second opening 450 is opposite the first opening 460. The first opening 460 may extend along a top side 412 of the storage apparatus 400. In some examples, a width of the first opening 460 is between 75% and 95% of the width of the top side 412 of the storage apparatus 400. The second opening 450 may extend along a bottom side 414 of the storage apparatus 400. In some examples, a width of the second opening 450 is between 15% and 35% of the width of the bottom side 414 of the storage apparatus 400.

The storage apparatus 400 may further include one or more tabs that can be folded into the pocket defined by the first pocket layer 402 and the second pocket layer 404. For example, storage apparatus 400 may include tabs 430, 420, and 422 along the top side 412 of the storage apparatus 400. Each of tabs 430, 420, 422 can be folded down into the formed pocket through first opening 460. In addition, storage apparatus 400 may include tabs 428, 426, and 424 that can be folded down into the formed pocket through slots 429, 425, and 423, respectively. Each tab 430, 420, 422, 428, 426, and 424 can include an opening through which a holding device, such as key rings 421 and 427, may be secured.

Figure 5:
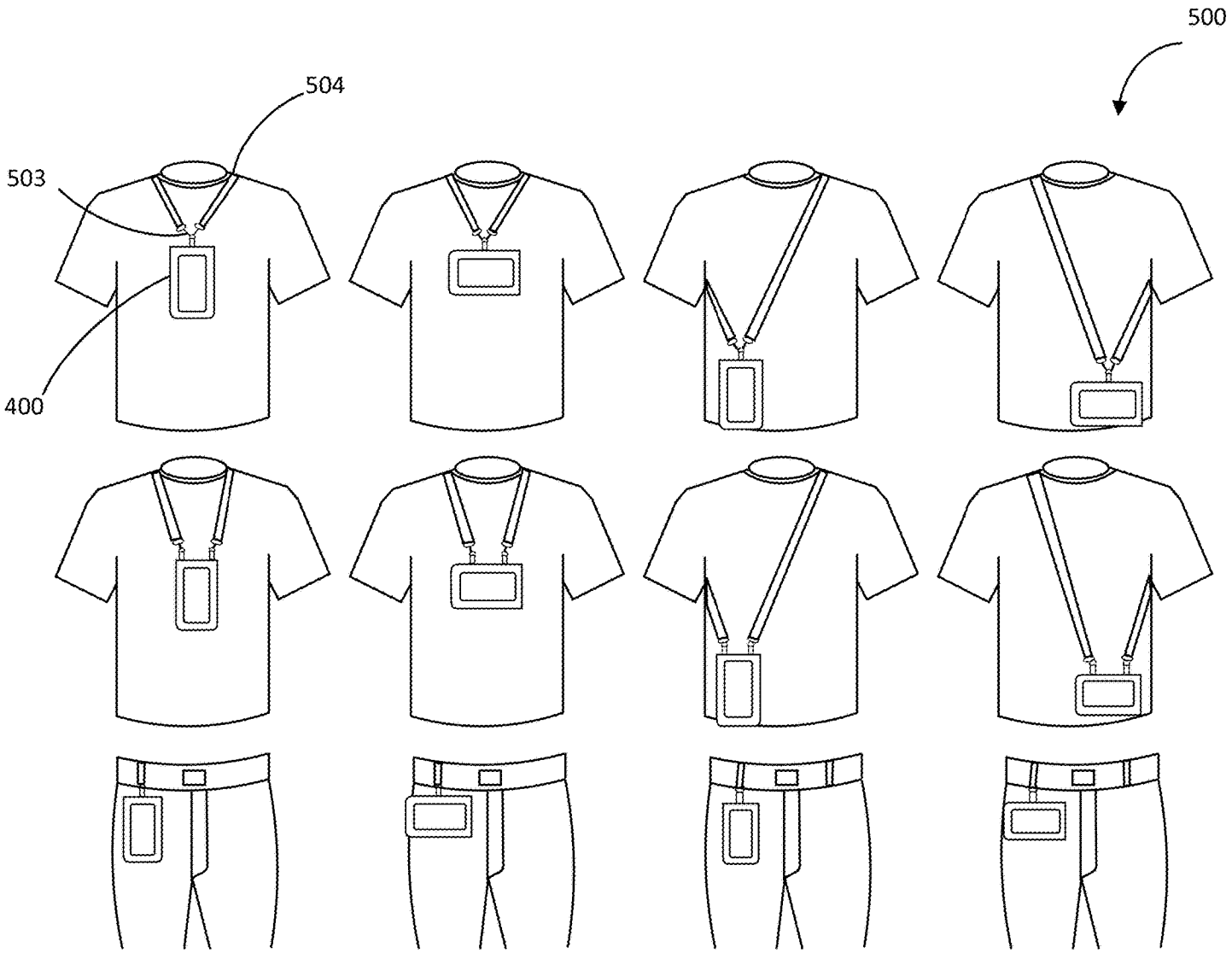
FIG. 5 illustrates various ways in which to secure a storage apparatus, in accordance with some embodiments.

FIG. 5 is diagram 500 illustrating various ways that storage apparatus 400 may be carried. As illustrated, a lanyard 504 may include a clip 503 at each end. Each clip 503 may be secured to a tab (e.g., tabs 430, 420, 422, 428, 426, and 424) of the storage apparatus 400. The tabs that are not in use may be folded into the formed pocket as described herein.

Figure 6A:
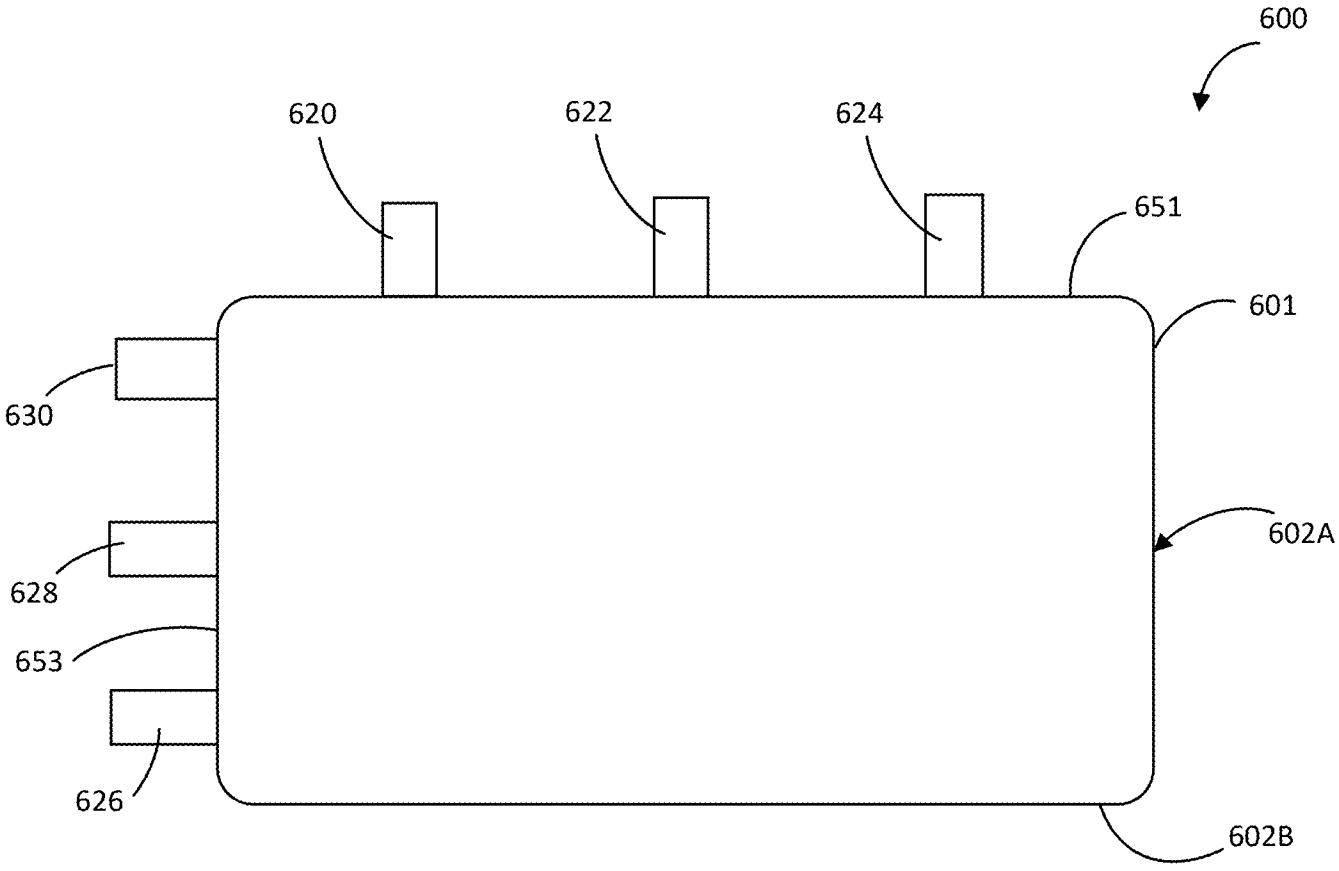
FIGS. 6A and 6B illustrate a card apparatus with multiple tabs, in accordance with some embodiments.

FIG. 6 illustrates a card apparatus 600 that includes a first rigid surface 602A and opposite a second rigid surface 602B. The first rigid surface 602A may be coupled to the second rigid surface 602B during manufacturing, with glue, stables, hook and loop material, or using any other suitable method. The first rigid surface 602A and second rigid surface 602B define (e.g., form) a rigid layer 601.

In addition, the card apparatus 600 includes one or more tabs along any of its edges. For example, as illustrated, the card apparatus 600 includes tabs 620, 622, and 624 along a first edge 651, and tabs 626, 628, and 630 along a second edge 653. The tabs include an opening through which a holding device may be secured. In some examples, the tabs form one continuous piece with one or more of the first rigid surface 602A and the second rigid surface 602B. In some examples, a portion of the tabs are displaced between the first rigid surface 602A and the second rigid surface 602B such as to secure the tabs in place. In yet other examples, the tabs are secured to one of the first rigid surface 602A and the second rigid surface 602B using hook and loop material, glue, staples, or any other suitable method. Although semi-rigid, the tabs are configured to be folded down onto the second rigid surface 602B (e.g., when not in use). Among other uses, the tabs can be used to tether a lanyard or other hardware such as clips, hooks, and rings.

Figure 6B:
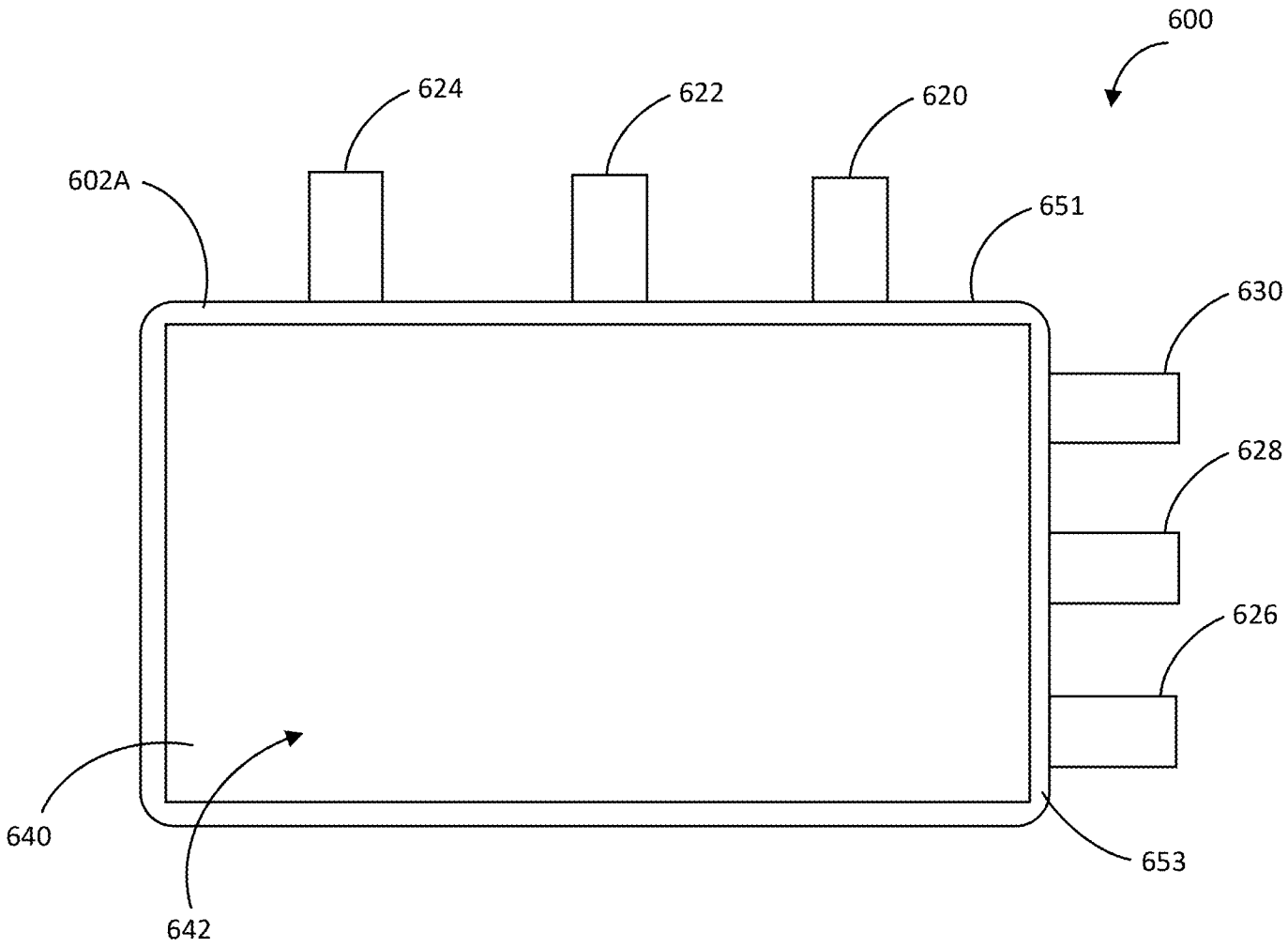

As illustrated in FIG. 6B, a transparent cover 640, such as a sleeve, may be secured to the first rigid surface 602A to allow for the placement of a document 642, such as an identification card (e.g., driver's license). The transparent cover 640 may be secured to the first rigid surface 602A using, for example, glue, staples, hook and loop material, or using any other suitable method.

In some examples, the card apparatus 600 is sized to fit within a smartphone case. For example, a width of the second edge 653 may be slightly less than a width of the smartphone case, and a width of the first edge 651 may be slightly less than a length of the smartphone case. In some use cases, a phone is removed from a phone case. The card apparatus 600 is then placed inside the phone case. Some of the tabs may need to be folded down to place the card apparatus 600 in the phone case (e.g., all tabs other than tab 628). In addition, a tab, such as tab 628, is pushed through a charging port hole on the phone case. The phone is then placed back in the phone case.

In some examples, the card apparatus 600 operates as a tethering device that allows a user to transport, view, display and operate a touch screen device, and/or to connect an attachment. For example, card apparatus 600 may allow for a single attachment in a vertical position around the waist (e.g., using tab 622), a double attachment in a vertical position around the neck (e.g., using tabs 626, 630), a single attachment in a horizontal position around the neck (e.g., using tab 622), a double attachment in a horizontal position around the neck (e.g., using tabs 620, 624), a single attachment in a vertical position around the waist (e.g., using tab 628), a double attachment in a vertical position around the waist (e.g., using tabs 626, 630), a single attachment in a horizontal position around the waist (e.g., using tab 622), or a double attachment in a horizontal position around the waist (e.g., using tabs 620, 624).

Card apparatus 600 may be manufactured from any textile or fabric material such as nylon, plastic, cotton, leather, vinyl leather, and faux leather, among other examples.

The foregoing is provided for purposes of illustrating, explaining, and describing embodiments of these disclosures. Modifications and adaptations to these embodiments will be apparent to those skilled in the art and may be made without departing from the scope or spirit of these disclosures.

What is claimed is:

1. An apparatus comprising:

a first pocket layer coupled to a second pocket layer, the first pocket layer and the second pocket layer defining a first pocket with a first opening and a second opening opposite the first opening;

a first tab coupled to the second pocket layer, the first tab configured to fold into the first opening of the first pocket;

a second tab coupled to the second pocket layer, the second tab configured to fold into a third opening of the first pocket from an extended position;

a third tab coupled to the second pocket layer, the third tab configured to fold into the first opening of the first pocket;

a fourth tab coupled to the second pocket layer, the fourth tab configured to fold into the first opening of the first pocket;

a fifth tab coupled to the second pocket layer, the fifth tab configured to fold into a fourth opening of the pocket from an extended position; and a sixth tab coupled to the second pocket layer, the sixth tab configured to fold into a fifth opening of the pocket from an extended position; and a transparent cover coupled to the first pocket layer;

wherein the first tab, the third tab, and the fourth tab are positioned along a same side of the second pocket layer.

2. The apparatus of claim 1, wherein the first tab is located on a first side of the second pocket layer, the second tab is located on a second side of the second pocket layer, and the first side is adjacent to the second side.

3. The apparatus of claim 2, wherein the first side is between 6 and 8 inches in length, inclusive, and the second side is between 4 and 6 inches in length, inclusive.

4. The apparatus of claim 1, further comprising a mesh backing coupled to the second pocket layer.

5. The apparatus of claim 1, wherein the transparent cover includes at least one aperture.

6. The apparatus of claim 1, wherein the second tab is configured to extend through the third opening when in the extended position.

7. The apparatus of claim 1 comprising a key ring coupled to the first tab.

8. The apparatus of claim 1, wherein the second tab, the fifth tab, and the sixth tab are positioned along a same side of the second pocket layer.

9. The apparatus of claim 1, wherein the transparent cover includes at least one aperture.

10. An apparatus comprising:

a first pocket layer coupled to a second pocket layer, the first pocket layer and the second pocket layer defining a first pocket with a first opening and a second opening opposite the first opening;

a third pocket layer coupled to the second pocket layer, the second pocket layer and the third pocket layer defining a second pocket with a first opening;

a first tab coupled to the third pocket layer, the first tab configured to fold into the first opening of the second pocket;

a second tab coupled to the third pocket layer, the second tab configured to fold into a second opening of the second pocket;

a third tab coupled to the second pocket layer, the third tab configured to fold into the second pocket;

a fourth tab coupled to the second pocket layer, the fourth tab configured to fold into the the second pocket;

a fifth tab coupled to the second pocket layer, the fifth tab configured to fold into the second pocket; and a sixth tab coupled to the second pocket layer, the sixth tab configured to fold into the second pocket; and a transparent cover coupled to the first pocket layer.

11. The apparatus of claim 10, wherein the first tab is located on a first side of the third pocket layer, the second tab is located on a second side of the third pocket layer, and the first side is adjacent to the second side.

12. The apparatus of claim 11, wherein the first side is between 6 and 8 inches in length, inclusive, and the second side is between 4 and 6 inches in length, inclusive.

13. The apparatus of claim 10 wherein the first tab, the third tab, and the fourth tab are located on a same side of the third pocket layer.

* * * * *